US007397328B2

(12) United States Patent
Yasuda et al.

(10) Patent No.: US 7,397,328 B2
(45) Date of Patent: Jul. 8, 2008

(54) BALANCED FILTER DEVICE

(75) Inventors: Hisahiro Yasuda, Gunma (JP); Takeshi Kosaka, Gunma (JP); Makoto Inoue, Gunma (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 272 days.

(21) Appl. No.: 11/241,163

(22) Filed: Sep. 30, 2005

(65) Prior Publication Data

US 2006/0071738 A1 Apr. 6, 2006

(30) Foreign Application Priority Data

Sep. 30, 2004 (JP) ..... 2004-289261
Oct. 21, 2004 (JP) ..... 2004-306829
May 30, 2005 (JP) ..... 2005-157411

(51) Int. Cl.
*H01P 1/203* (2006.01)

(52) U.S. Cl. ..... 333/204; 333/26

(58) Field of Classification Search ..... 333/25, 333/26, 204, 205
See application file for complete search history.

(56) References Cited

U.S. PATENT DOCUMENTS 6,294,965 B1 * 9/2001 Merrill et al. ..... 333/26
6,420,942 B1 7/2002 Hiroshima et al.
6,538,534 B2 * 3/2003 Hirai et al. ..... 333/204
6,788,164 B2 * 9/2004 Maekawa et al. ..... 333/26
6,819,199 B2 * 11/2004 Burns et al. ..... 333/26
7,126,444 B2 * 10/2006 Fukunaga et al. ..... 333/204
7,256,663 B2 * 8/2007 Yasuda et al. ..... 333/26
2006/0022773 A1 * 2/2006 Iwasaki et al. ..... 333/204

FOREIGN PATENT DOCUMENTS

EP 1 394 894 A1 3/2004
JP 06-077703 3/1994
JP 07-273516 10/1995
JP 2001-036310 2/2001
JP 2003-087008 3/2003
JP 2004-056745 2/2004
JP 2004-112787 4/2004
JP 2005-080248 3/2005
JP 2000-134009 12/2005

* cited by examiner

*Primary Examiner*—Seungsook Ham
(74) *Attorney, Agent, or Firm*—Knobbe Martens Olson & Bear LLP

(57) ABSTRACT

A balanced filter suitable for a reduction of the filter size. The balanced filter comprises strip-line resonators (SL1*a*, SL1*b*) constituting resonance electrodes on the unbalanced side, strip-line resonators (SL2*a*, SL2*b*) disposed in adjacently opposed relation to the strip-lines on the unbalanced side and constituting resonance electrodes on the balanced side, strip-line resonators (SL3*a*, SL3*b*) disposed in adjacently opposed relation to the strip-lines on the balanced side and constituting stage constituting resonance electrodes, and impedance elements (Z) coupling the resonance electrodes on the balanced side to the stage constituting resonance electrodes.

11 Claims, 32 Drawing Sheets

(a)

(b)

(a)

(b)

(a)

(b)

(a)

(b)

(a)

(b)

(a)

(b)

(a)

(b)

(a)

(b)

(a)

(b)

(b)

(b)

(a)

(b)

(a)

(b)

(a)

(b)

BALANCED FILTER DEVICE

BACKGROUND OF THE INVENTION

1. Field of the Invention

The present invention relates to a balanced filter having the function of a balun performing conversion between unbalanced and balanced signals and the function of a filter performing band control, and more particularly to a balanced filter effective in reducing a filter size.

2. Description of the Related Art

Radio communication equipment comprises various RF (radio frequency) devices, such as an antenna, a filter, an RF switch, a power amplifier, an RF-IC, and a balun. Among these parts, resonance devices, such as an antenna and a filter, handle an unbalanced signal on the basis of the ground potential, while an RF-IC for producing and processing an RF signal handles a balanced signal. A balun functioning as an unbalance-balance transformer is therefore used when those two types of parts are connected to each other.

That type of balun is disclosed, for example, in the following Patent Documents:

Patent Document 1: Japanese Unexamined Patent Application Publication No. 2000-134009

Patent Document 2: Japanese Unexamined Patent Application Publication No. 2001-36310

The baluns disclosed in those Patent Documents are of the type that an unbalanced line and a balanced line are coupled through a coupling line. In the structures of those baluns, as shown in FIG. 3 of Patent Document 2, the unbalanced line and the balanced line are formed on one substrate, and the coupling line is formed on another substrate. The coupling line is laid over both the unbalanced line and the balanced line so that the unbalanced line and the balanced line are coupled to each other.

In a coupling mode of the balun thus constructed, as shown in FIG. 8 and explained in paragraph 0016 of Patent Document 2, "an unbalanced signal inputted from an unbalanced signal terminal 3 is propagated in the order of a first coupling line 101, a second coupling line 102, and a third coupling line 103".

With the balun structures disclosed in Patent Documents 1 and 2, however, a resulting frequency characteristic is as shown in FIG. 4 of Patent Document 2. Accordingly, the disclosed structures are usable as a balun, but they have a difficulty in ensuring a band characteristic required for the filter.

On the other hand, many balanced filters each comprising a balun and a filter combined into an integral unit have recently been devised with the intent to reduce the size of radio communication equipment. That type of balanced filter is disclosed, for example, in the following Patent Document:

Patent Document 3: Japanese Unexamined Patent Application Publication No. 2003-087008

The balanced filter disclosed in Patent Document 3 has a structure in which a filter and a balun each designed using a ¼-wavelength resonator are combined on a dielectric substrate. A dielectric layer constituting the filter and a dielectric layer constituting the balun are formed one above the other in an integral structure.

Also, Patent Document 3 discloses a structure in which a DC power supply layer is formed in the balun, for making the balanced filter adaptable for the case where the RF-IC requires a balanced signal superimposed on a DC component. This structure is intended to realize a further reduction of the filter size.

However, the structure in which a balun section and a filter section are separately formed and integrated together has the problem as follows. When the filter function with a high attenuation is demanded, the filter section is required to have a multistage structure. Therefore, satisfactory flexibility in design cannot be ensured in a limited space, and a reduction of the size is very difficult to realize.

SUMMARY OF THE INVENTION

Accordingly, it is an object of the present invention to provide a balanced filter which is effective in realizing a high attenuation and a size reduction.

To achieve the above object, one embodiment provides a balanced filter device comprising an unbalanced-side resonance electrode and a balanced-side resonance electrode, wherein the balanced filter device further comprises a stage constituting resonance electrode formed in comb-line arrangement relative to the unbalanced-side resonance electrode and/or the balanced-side resonance electrode.

By thus arranging another resonance electrode in comb-line arrangement relative to the resonance electrode constituting a balun, the balun and a filter are constituted at the same time in a state partly sharing resonators. Therefore, the signal converting function of the balun and the band control effect of the filter can be both obtained with a simple structure. Here, the term "comb-line arrangement" means the arrangement that respective shorted ends of the resonance electrodes are positioned to face in the same direction.

Another embodiment provides a balanced filter device comprising an unbalanced-side resonance electrode and a balanced-side resonance electrode, wherein the balanced filter device further comprises a stage constituting resonance electrode coupled to the balanced-side resonance electrode through an impedance element.

By thus coupling the balanced-side resonance electrode and the stage constituting resonance electrode through the impedance element, a band control effect can be obtained in the filter. Here, the impedance element may be a capacitive or inductive device. In practice, the balanced-side resonance electrode and the stage constituting resonance electrode can be arranged in opposed relation with a dielectric interposed between them, to thereby establish capacitive coupling. Alternatively, the balanced-side resonance electrode and the stage constituting resonance electrode can be coupled to each other through a line having an inductance component.

Another embodiment has multi-path coupling formed between the stage constituting resonance electrode and the unbalanced-side resonance electrode.

By thus forming the multi-path coupling, second and third extremes can be given to the resulting filter characteristic, and a sharper filter function can be obtained. Here, the term "multi-path coupling" means a capacitive or inductive coupling path formed between one electrode and another electrode.

In some embodiments the coupling portions of the unbalanced-side resonance electrode and the balanced-side resonance electrode are formed of strip-lines each having a length of $\lambda/4$, and the stage constituting resonance electrode is formed of a strip-line having a length different from $\lambda/4$.

By thus forming the stage constituting resonance electrode of a strip-line having a length different from $\lambda/4$, an adjustment of inner-layer impedance can be realized with change in the length of the stage constituting resonance electrode.

Another embodiment provides a balanced filter device comprising an unbalanced-side resonance electrode and a balanced-side resonance electrode, wherein the balanced filter device further comprises a stage constituting resonance electrode arranged adjacent to the unbalanced-side resonance electrode and/or the balanced-side resonance electrode, and the unbalanced-side resonance electrode and the balanced-side resonance electrode are arranged adjacent to each other.

With that arrangement, the balanced filter device having both the functions of a balun and a filter can be obtained with a simple structure. The stage constituting resonance electrode may be arranged adjacent to one or both of the unbalanced-side resonance electrode and the balanced-side resonance electrode. Preferably, the stage constituting resonance electrode is arranged adjacent to the balanced-side resonance electrode so that a high-attenuation filter effect is obtained.

Another embodiment provides a balanced filter device comprising an unbalanced-side resonance electrode and a balanced-side resonance electrode, wherein the balanced filter device further comprises a stage constituting resonance electrode arranged opposite to the unbalanced-side resonance electrode or the balanced-side resonance electrode, and the unbalanced-side resonance electrode and the balanced-side resonance electrode are arranged opposite to each other.

With that arrangement, the balanced filter device having both the functions of a balun and a filter can be obtained with a simple structure. The stage constituting resonance electrode may be arranged opposite to one or both of the unbalanced-side resonance electrode and the balanced-side resonance electrode. Preferably, the stage constituting resonance electrode is arranged opposite to the balanced-side resonance electrode so that a high-attenuation filter effect is obtained. In addition, the stage constituting resonance electrode may be arranged in entirely or partly opposite relation to the corresponding resonance electrode.

Another embodiment provides a balanced filter device comprising an unbalanced-side resonance electrode and a balanced-side resonance electrode, wherein the balanced filter device further comprises a stage constituting resonance electrode arranged adjacent to the unbalanced-side resonance electrode and/or the balanced-side resonance electrode, and the unbalanced-side resonance electrode, the balanced-side resonance electrode and the stage constituting resonance electrode are each formed of a strip-line.

With that arrangement, since electromagnetic coupling caused between the resonance electrodes is effectively utilized, the balanced filter device having both the functions of a balun and a filter can be obtained with a simple structure.

Another embodiment provides a balanced filter device being of a strip-line structure in which an unbalanced-side resonance electrode formed on a first dielectric layer and a balanced-side resonance electrode formed on a second dielectric layer are sandwiched between a pair of GND electrodes formed respectively on third and fourth dielectric layers, wherein the balanced filter device further comprises a stage constituting resonance electrode formed on a fifth dielectric layer, the unbalanced-side resonance electrode and the balanced-side resonance electrode are arranged opposite to each other, and the balanced-side resonance electrode and the stage constituting resonance electrode are arranged opposite to each other.

With that arrangement, since a balun and a filter are formed at the same time in a state partly sharing the resonance electrodes, the balanced filter device having both the functions of the balun and the filter can be obtained with a simple structure.

Some embodiments further comprise a coupling electrode formed on a sixth dielectric layer, the coupling electrode being arranged between the balanced-side resonance electrode and the stage constituting resonance electrode.

With that arrangement, since coupling between the balanced-side resonance electrode and the stage constituting resonance electrode is established by utilizing a laminated structure, a satisfactory filter band control effect can be obtained in the filter with a small-sized structure.

Another embodiment further comprises a DC electrode formed on a sixth dielectric layer, the DC electrode being arranged between the stage constituting resonance electrode and the GND electrodes.

With that arrangement, since a DC supply line is formed as an inner layer by utilizing a laminated structure, the balanced filter device including the DC supply line can be obtained with a simple structure.

As described above, some embodiments can provide the balanced filter having a small-sized structure and a high attenuation.

Further, another embodiment provides a balanced filter device comprising an unbalanced-side resonance electrode and a balanced-side resonance electrode, wherein a stage constituting resonance electrode having a shorted end at one end and an open end at the other end is arranged adjacent to the unbalanced-side resonance electrode and/or the balanced-side resonance electrode.

By thus arranging the resonance electrode having a shorted end at one end and an open end at the other end adjacent to the resonance electrode constituting a balun, the former resonance electrode is electromagnetically coupled to the resonance electrode constituting the balun. As a result, a trap is formed in a frequency characteristic and a band control effect can be obtained in the filter.

Another embodiment provides a balanced filter device comprising an unbalanced-side resonance electrode and a balanced-side resonance electrode, wherein the balanced filter device further comprises a stage constituting resonance electrode having a shorted end and an open end and being arranged adjacent to the unbalanced-side resonance electrode and/or the balanced-side resonance electrode, and the unbalanced-side resonance electrode and the balanced-side resonance electrode are arranged adjacent to each other.

With that arrangement, the balanced filter device having both the functions of a balun and a filter can be obtained with a simple structure. The stage constituting resonance electrode may be arranged adjacent to one or both of the unbalanced-side resonance electrode and the balanced-side resonance electrode. Preferably, the stage constituting resonance electrode is arranged adjacent to the balanced-side resonance electrode so that a high-attenuation filter effect is obtained.

Another embodiment provides a balanced filter device comprising an unbalanced-side resonance electrode and a balanced-side resonance electrode, wherein the balanced filter device further comprises a stage constituting resonance electrode having a shorted end and an open end and being arranged opposite to the unbalanced-side resonance electrode or the balanced-side resonance electrode, and the unbalanced-side resonance electrode and the balanced-side resonance electrode are arranged opposite to each other.

With that arrangement, the balanced filter device having both the functions of a balun and a filter can be obtained with a simple structure. The stage constituting resonance electrode may be arranged opposite to one or both of the unbalanced-side resonance electrode and the balanced-side resonance electrode. Preferably, the stage constituting resonance electrode is arranged opposite to the balanced-side resonance electrode so that a high-attenuation filter effect is obtained. In addition, the stage constituting resonance electrode may be arranged in entirely or partly opposite relation to the corresponding resonance electrode.

Another embodiment provides a balanced filter device comprising an unbalanced-side resonance electrode and a balanced-side resonance electrode, wherein the balanced filter device further comprises a stage constituting resonance electrode having a shorted end and an open end and being arranged adjacent to the unbalanced-side resonance electrode and/or the balanced-side resonance electrode, and the unbalanced-side resonance electrode, the balanced-side resonance electrode and the stage constituting resonance electrode are each formed of a strip-line.

With that arrangement, since electromagnetic coupling caused between the resonance electrodes is effectively utilized, the balanced filter device having both the functions of a balun and a filter can be obtained with a simple structure.

Another embodiment provides a balanced filter device being of a strip-line structure in which an unbalanced-side resonance electrode formed on a first dielectric layer and a balanced-side resonance electrode formed on a second dielectric layer are sandwiched between a pair of GND electrodes formed respectively on third and fourth dielectric layers, wherein the balanced filter device further comprises a stage constituting resonance electrode formed on a fifth dielectric layer having a shorted end and an open end, the unbalanced-side resonance electrode and the balanced-side resonance electrode are arranged opposite to each other, and the balanced-side resonance electrode and the stage constituting resonance electrode are arranged opposite to each other.

With that arrangement, the stage constituting resonance electrode is coupled to the resonance electrode constituting a balun, and a trap is formed in a frequency characteristic. Therefore, the balanced filter device having both the functions of a balun and a filter can be obtained with a simple structure.

Some embodiments further comprise a wavelength shortening electrode formed on a sixth dielectric layer, wherein one end of the stage constituting resonance electrode is shorted through the wavelength shortening electrode.

With that arrangement, one end of the stage constituting resonance electrode can be shorted and a wavelength shortening effect can be obtained with the wavelength shortening electrode. Therefore, the filter having a small-sized structure and a satisfactory band control effect can be provided.

Another embodiment further comprises a DC electrode formed on a sixth dielectric layer, the DC electrode being arranged between the stage constituting resonance electrode and the GND electrodes and being connected to the balanced-side resonance electrode.

Another embodiment provides a balanced filter comprising an unbalanced-side resonance electrode and a balanced-side resonance electrode, the balanced filter device further comprising a stage constituting resonance electrode interposed between the unbalanced-side resonance electrode and the balanced-side resonance electrode; and a coupling electrode interposed between the unbalanced-side resonance electrode and the stage constituting resonance electrode and being arranged opposite to the electrodes.

By thus interposing the stage constituting resonance electrode between the unbalanced-side resonance electrode and the balanced-side resonance electrode, electromagnetic coupling caused between the resonance electrodes is effectively utilized. Therefore, the balanced filter device having both the functions of a balun and a filter can be obtained with a simple structure.

Further, by interposing the coupling electrode between the unbalanced-side resonance electrode and the stage constituting resonance electrode, the position of a trap formed at the lower frequency side in a passage band can be controlled without noticeably affecting the passage band. As a result, a larger attenuation rate can be obtained at a desired frequency.

Another embodiment provides a balanced filter comprising an unbalanced-side resonance electrode and a balanced-side resonance electrode, the balanced filter further comprising a stage constituting resonance electrode interposed between the unbalanced-side resonance electrode and the balanced-side resonance electrode; and a coupling electrode arranged opposite to the unbalanced-side resonance electrode, the unbalanced-side resonance electrode having two $\lambda/4$ strip-line portions formed by folding a strip-line having a length of $\lambda/2$ at a position where the $\lambda/2$ strip-line is divided into the two $\lambda/4$ strip-line portions, the coupling electrode coupling the two $\lambda/4$ strip-line portions to each other.

By thus coupling the two $\lambda/4$ strip-line portions constituting the unbalanced-side resonance electrode to each other, the position of a trap formed at the lower frequency side in a passage band can be satisfactorily controlled without noticeably affecting the passage band.

Another embodiment provides a balanced filter comprising an unbalanced-side resonance electrode and a balanced-side resonance electrode, the balanced filter further comprising a stage constituting resonance electrode interposed between the unbalanced-side resonance electrode and the balanced-side resonance electrode; and a coupling electrode arranged opposite to the stage constituting resonance electrode, the stage constituting resonance electrode being made up of two strip-lines each having a length of about $\lambda/4$, the coupling electrode coupling the two strip-lines to each other.

By thus coupling the two about-$\lambda/4$ strip-line portions constituting the stage constituting resonance electrode to each other, the position of a trap formed at the lower frequency side in a passage band can be satisfactorily controlled without noticeably affecting the passage band. In addition, by adjusting the length of the stage constituting resonance electrode in the range of $\lambda/4\pm\alpha$ as appropriate, an adjustment effect corresponding to $\pm\alpha$ can be obtained.

Some embodiments provide a balanced filter comprising an unbalanced-side resonance electrode and a balanced-side resonance electrode, the balanced filter further comprising a stage constituting resonance electrode interposed between the unbalanced-side resonance electrode and the balanced-side resonance electrode; and a coupling electrode arranged opposite to the unbalanced-side resonance electrode, the unbalanced-side resonance electrode having two $\lambda/4$ strip-line portions formed by folding a strip-line having a length of $\lambda/2$ at a position where the $\lambda/2$ strip-line is divided into the two $\lambda/4$ strip-line portions, the coupling electrode coupling the $\lambda/4$-divided position and a position closer to each end of the strip-line than the $\lambda/4$-divided position.

By thus coupling the $\lambda/4$-divided position of the unbalanced-side resonance electrode formed of the strip-line having the length of $\lambda/2$ and the position closer to each end of the strip-line than the $\lambda/4$-divided position, the position of a trap formed at the lower frequency side in a passage band can be satisfactorily controlled without noticeably affecting the passage band.

Another embodiment provides a balanced filter comprising an unbalanced-side resonance electrode and a balanced-side resonance electrode, the balanced filter further comprising a stage constituting resonance electrode interposed between the unbalanced-side resonance electrode and the balanced-side resonance electrode; and a coupling electrode arranged opposite to the stage constituting resonance electrode, the coupling electrode coupling a shorted-end side and an open-end side of the stage constituting resonance electrode to each other.

By thus coupling the shorted-end side and the open-end side of the stage constituting resonance electrode to each other, the position of a trap formed at the lower frequency side in a passage band can be satisfactorily controlled without noticeably affecting the passage band.

In the arrangements described above, the stage constituting resonance electrode is preferably arranged adjacent and opposite to both the unbalanced-side resonance electrode and the balanced-side resonance electrode so that a high-attenuation filter effect is obtained. The stage constituting resonance electrode may be arranged in entirely or partly opposite relation to the unbalanced-side resonance electrode and the balanced-side resonance electrode.

With that arrangement, since a DC supply line is formed as an inner layer by utilizing a laminated structure, the balanced filter device including the DC supply line can be obtained with a simple structure.

As described above, some embodiments provide the balanced filter having a small-sized structure and a high attenuation.

DESCRIPTION OF CERTAIN EMBODIMENTS

Embodiments of the present invention will be described in detail below with reference to the accompanying drawings. Note that the present invention is not limited to the following embodiments and can be modified as required.

Figure 1:
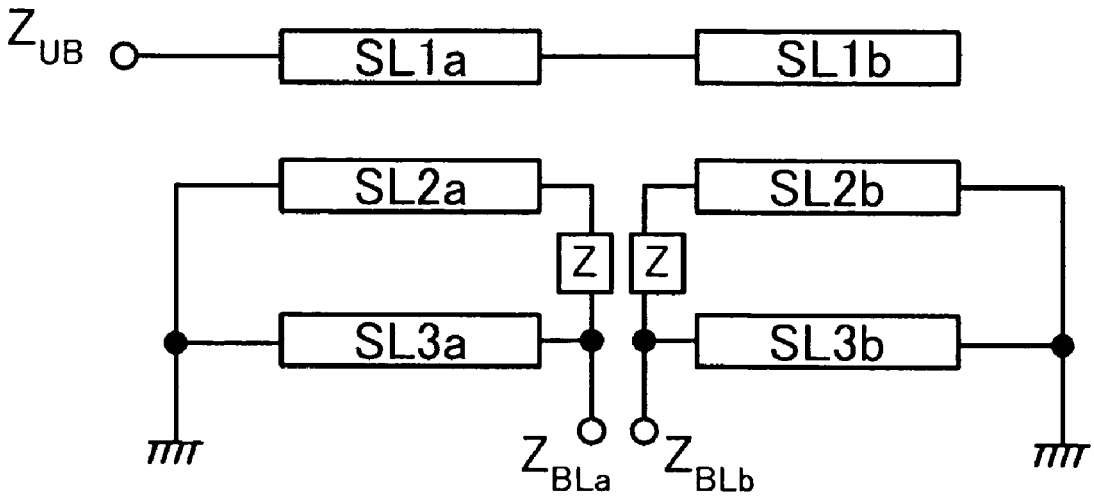
FIG. 1 is an equivalent circuit diagram showing features of a balanced filter according to one embodiment.

FIG. 1 is an equivalent circuit diagram showing features of a balanced filter according to one embodiment. As shown in FIG. 1, the balanced filter according to this embodiment comprises strip-line resonators SL1*a* and SL1*b* constituting resonance electrodes on the unbalanced side, strip-line resonators SL2*a* and SL2*b* constituting resonance electrodes on the balanced side, strip-line resonator SL3*a* and SL3*b* constituting stage constituting resonance electrodes, and impedance elements Z coupling the resonance electrodes on the balanced side to the stage constituting resonance electrodes.

The unbalanced-side resonance electrodes SL1*a* and SL1*b* are each formed of a λ/4 strip-line. As shown in FIG. 1, those strip-lines are connected to each other at their one ends. Then, the other end of the unbalanced-side resonance electrode SL1*a* is connected to an unbalanced terminal $Z_{UB}$, and the other end of the unbalanced-side resonance electrode SL1*b* is constituted as an open end.

The balanced-side resonance electrodes SL2*a* and SL2*b* are each formed of a λ/4 strip-line shorted at one end. As shown in FIG. 1, the balanced-side resonance electrodes SL2*a* and SL2*b* are arranged adjacent to the unbalanced-side resonance electrodes SL1*a* and SL1*b*, respectively.

The stage constituting resonance electrodes SL3*a* and SL3*b* are each formed of a strip-line shorted at one end. As shown in FIG. 1, the stage constituting resonance electrodes SL3*a* and SL3*b* are arranged adjacent to the balanced-side resonance electrodes SL2*a* and SL2*b*, respectively. Each of these stage constituting resonance electrodes SL3*a* and SL3*b* has a length decided with impedance adjustment on the basis of λ/4.

The balanced-side resonance electrodes SL2*a* and SL2*b* and the stage constituting resonance electrodes SL3*a* and SL3*b* are constituted in comb-line arrangement in which the open ends and the shorted ends of the resonators are laid to face in the same direction, and every pairs of those electrodes are connected to each other at the open end side through the impedance elements Z. Further, the open ends of those electrodes are connected to balanced terminal $Z_{BLa}$ and $Z_{BLb}$.

With that arrangement, electromagnetic coupling occurs between one resonator and another resonator adjacent to it. Consequently, a balun section is formed by mutual coupling between the unbalanced-side resonance electrodes SL1*a*, SL1*b* and the balanced-side resonance electrodes SL2*a*, SL2*b*, while a filter section is formed by mutual coupling between the balanced-side resonance electrodes SL2*a*, SL2*b* and the stage constituting resonance electrodes SL3*a*, SL3*b*.

As a result, the balun function and the filter function can be obtained with the structure in which the balanced-side resonance electrodes SL2*a* and SL2*b* are shared by the balun section and the filter section. Hence, a balanced filter having a simple structure, a small size and a low cost can be realized.

Figure 2:
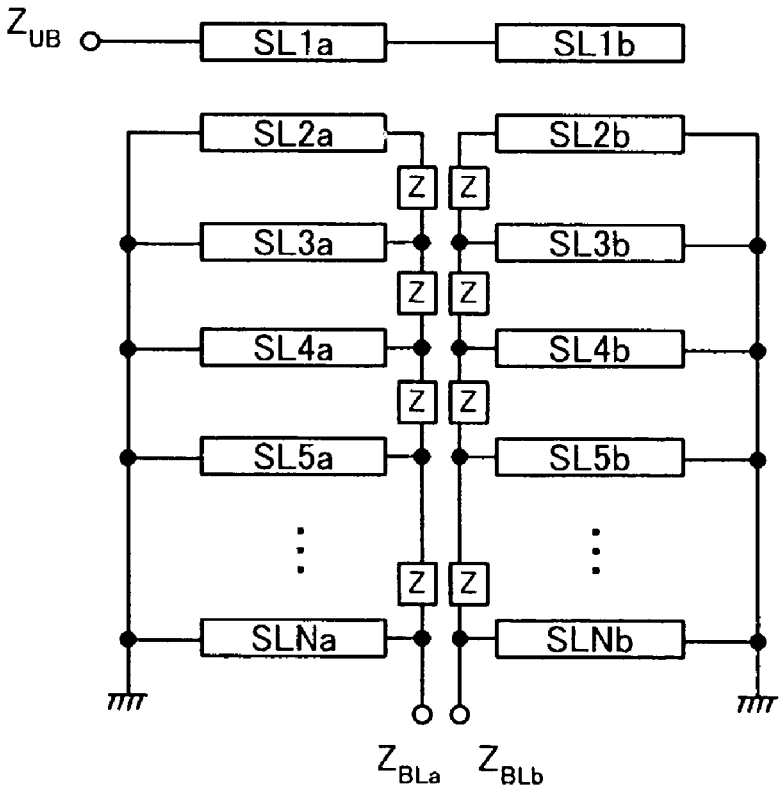
FIG. 2 is an equivalent circuit diagram showing an example in which the balanced filter shown in FIG. 1 is constructed in multiple stages.

FIG. 2 is an equivalent circuit diagram showing an example in which the balanced filter shown in FIG. 1 is constructed in multiple stages. When it is desired to enhance the filter function of the balanced filter shown in FIG. 1, the stage constituting resonance electrodes SL4*a*, SL4*b*-SLNa, SLNb may be added in multistage arrangement with impedance elements Z disposed between the adjacent electrodes, as shown in FIG. 2.

Figure 3:
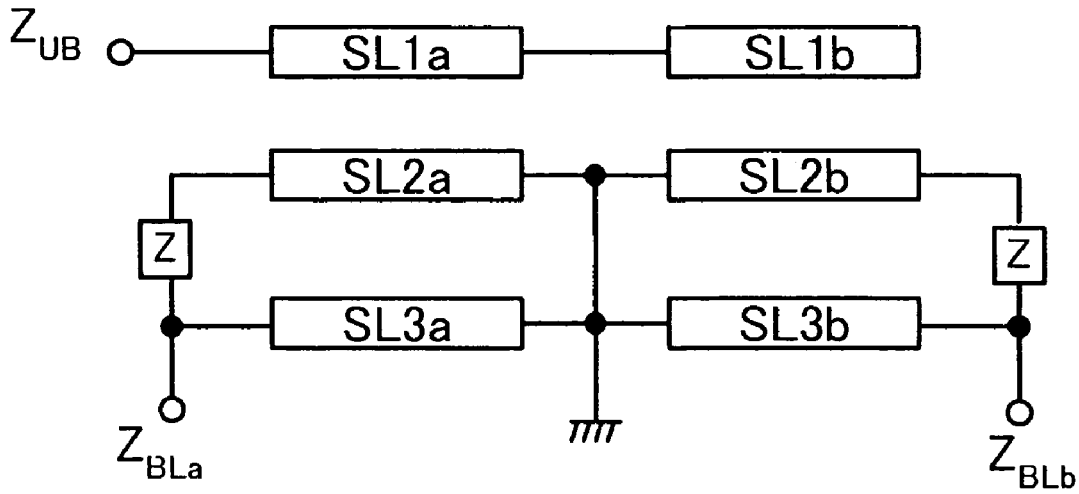
FIG. 3 is an equivalent circuit diagram showing an example in which a shorted end and an open end of the balanced filter shown in FIG. 1 are changed in directions to face.

FIG. 3 is an equivalent circuit diagram showing an example in which a shorted end and an open end of the balanced filter shown in FIG. 1 are changed in directions to face. As shown in FIG. 3, the balanced-side resonance electrodes SL2*a* and SL2*b* may be shorted at the junction between them, and those resonance electrodes SL2*a* and SL2*b* may be connected at outer ends to balanced terminals $Z_{BLa}$ and $Z_{BLb}$, respectively. In this case, the stage constituting resonance electrodes SL3*a* and SL3*b* are also shorted at the junction between them corresponding to the balanced-side resonance electrodes, and those resonance electrodes SL3*a* and SL3*b* are connected at outer ends to the balanced-side resonance electrodes through impedance elements Z.

Figure 4:
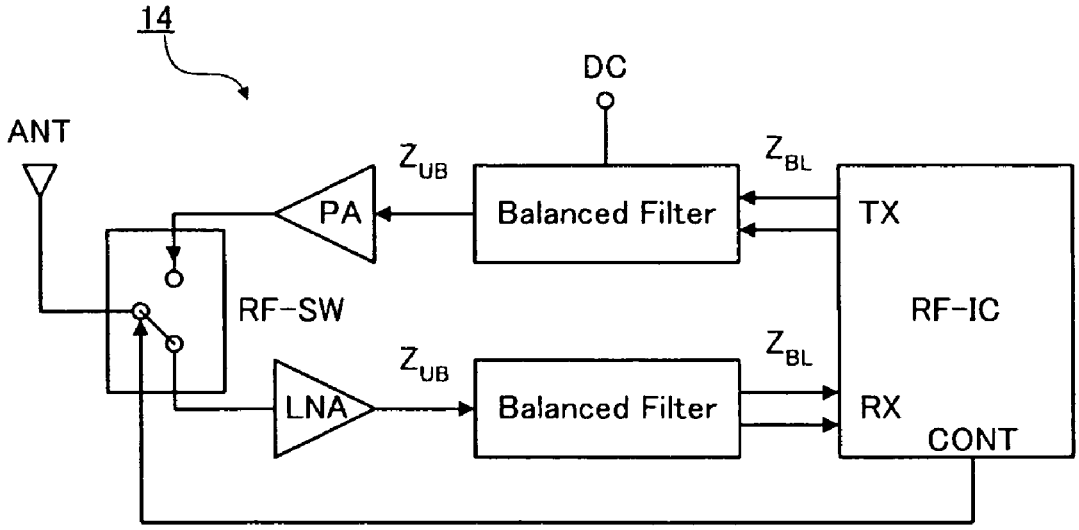
FIG. 4 is a circuit block diagram showing the configuration of an RF front end section in which the balanced filter according to one embodiment is assembled.

FIG. 4 is a circuit block diagram showing the configuration of an RF front end section in which the balanced filter according to one embodiment is assembled. In a radio communication circuit 14 shown in FIG. 4, the balanced filter is assembled in each of a transmitting path TX and a receiving path RX, and DC power is supplied to the balanced filter arranged on the transmitting path TX side.

As shown in FIG. 4, the radio communication circuit 14 comprises an antenna (ANT) for transmitting and receiving electric waves, an RF switch (RF-SW) for switching over the transmitting path TX and the receiving path RX, a power amplifier (PA) for amplifying a signal in the transmitting path TX, a low-noise amplifier (LNA) for amplifying a signal in the receiving path RX, the balanced filter disposed in each of the transmitting path TX and the receiving path RX, and an integrated circuit (RF-IC) for generating and processing an RF signal. The switching between the transmitting path TX and the receiving path RX is performed in response to a signal outputted from a control port (CONT) of the integrated circuit (RF-IC).

A signal received by the antenna (ANT) is inputted to the balanced filter in the form of an unbalanced signal on the basis of the GND potential via the RF switch (RF-SW) and the low-noise amplifier (LNA). The balanced filter converts the unbalanced signal to the balanced signal having a phase difference of 180°, and the converted balanced signal is inputted to a receiving port RX of the integrated circuit (RF-IC).

On the other hand, a transmission signal generated from the integrated circuit (RF-IC) is inputted in the form of a balanced signal to the transmitting-side balanced filter from a transmitting port TX. The transmitting-side balanced filter converts the balanced signal to an unbalanced signal with a DC bias applied to the balanced terminal. The converted unbalanced signal is radiated from the antenna (ANT) via the power amplifier (PA) and the RF switch (RF-SW).

While the example shown in FIG. 4 has been described as adding a DC signal to the balun disposed in the transmitting path TX, the DC signal may be added to the receiving path RX side depending on the specification of the radio communication circuit. Alternatively, the circuit configuration may be modified such that the DC signal is not added to both the transmitting and receiving paths.

Figure 5:
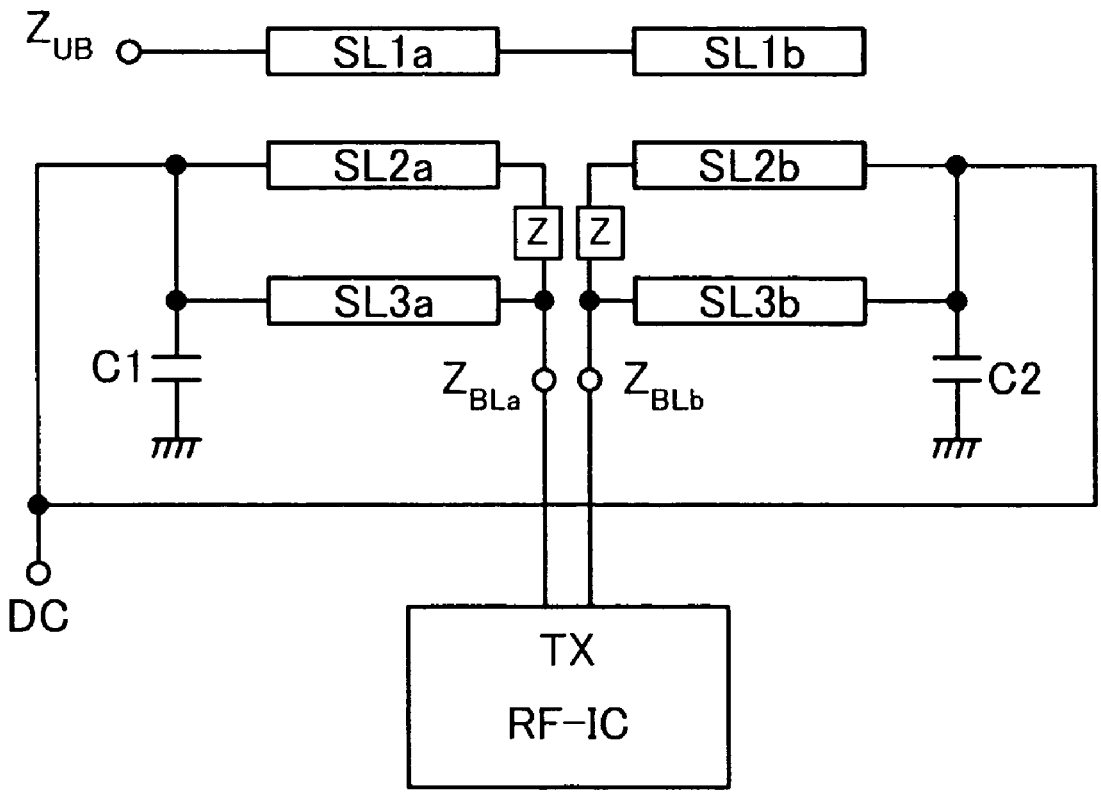
FIG. 5 is a circuit block diagram showing an equivalent circuit of a transmitting-side balanced filter shown in FIG. 4.

FIG. 5 is a circuit block diagram showing an equivalent circuit of the transmitting-side balanced filter shown in FIG. 4. As shown in FIG. 5, the transmitting-side balanced filter supplied with the DC signal comprises strip-line resonators SL1*a* and SL1*b* constituting resonance electrodes on the unbalanced side, strip-line resonators SL2*a* and SL2*b* constituting resonance electrodes on the balanced side, resonance electrodes SL3*a* and SL3*b* for band control, and capacitors C1 and C2 for bypassing AC signals. Then, the transmitting-side balanced filter is connected at the unbalanced terminal side to the power amplifier (PA), shown in FIG. 4, via an unbalanced terminal $Z_{UB}$, and is connected at the balanced terminal side to the integrated circuit (RF-IC) via balanced terminals $Z_{BLa}$ and $Z_{BLb}$.

Figure 6:
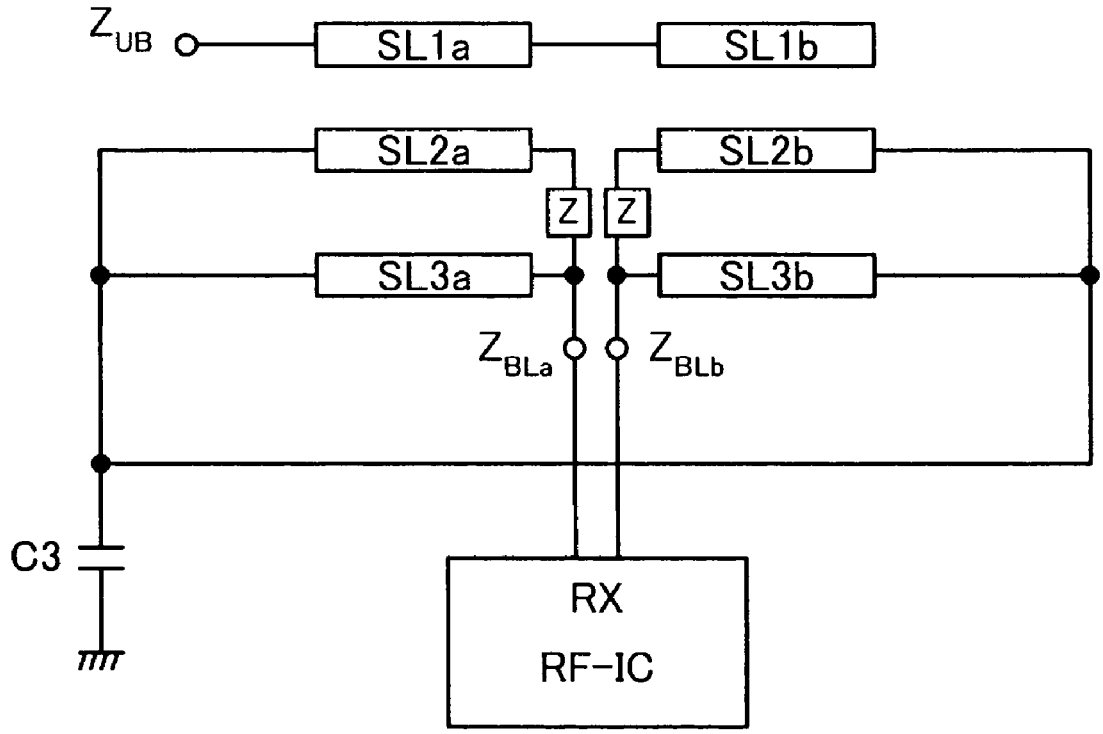
FIG. 6 is a circuit block diagram showing an equivalent circuit of a receiving-side balanced filter shown in FIG. 4.

FIG. 6 is a circuit block diagram showing an equivalent circuit of the receiving-side balanced filter shown in FIG. 4. As shown in FIG. 6, the receiving-side balanced filter is constituted such that the DC supply section is omitted from the transmitting-side balanced filter shown in FIG. 5 and a capacitor C3 for adjusting characteristics is disposed instead of the capacitors C1 and C2 for bypassing AC signals.

Figure 7:
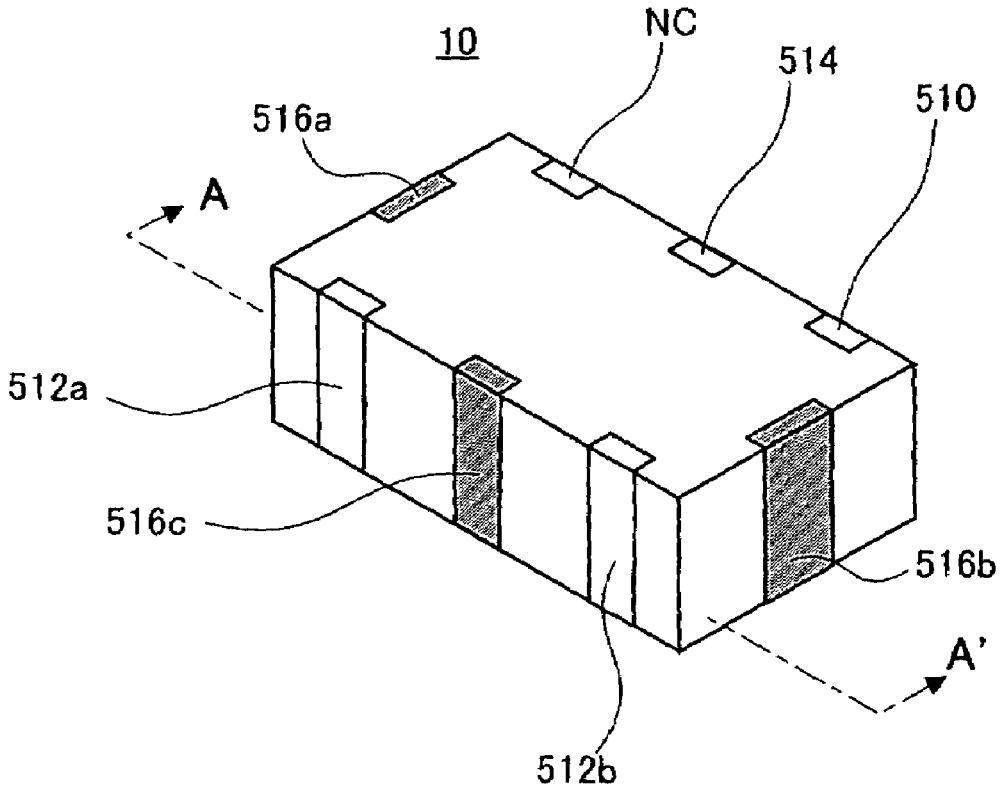
FIG. 7 is a perspective view showing, in external appearance, the structure of the balanced filter according to one embodiment.

FIG. 7 is a perspective view showing, in external appearance, the structure of the balanced filter according to one embodiment. As shown in FIG. 7, a balanced filter 10 of this embodiment has, as external terminal electrodes, an unbalanced terminal 510, balanced terminals 512*a* and 512*b*, a DC terminal 514, and GND terminals 516*a*, 516*b* and 516*c*. Additionally, a terminal denoted by "NC" in FIG. 7 is an unconnected terminal. Because the unbalanced-side resonance electrodes formed inside the balanced filter is arranged in symmetrical shape between the NC terminal and the unbalanced terminal 510, the unbalanced terminal 510 and the NC terminal can be used in a replaceable manner.

Figure 8:
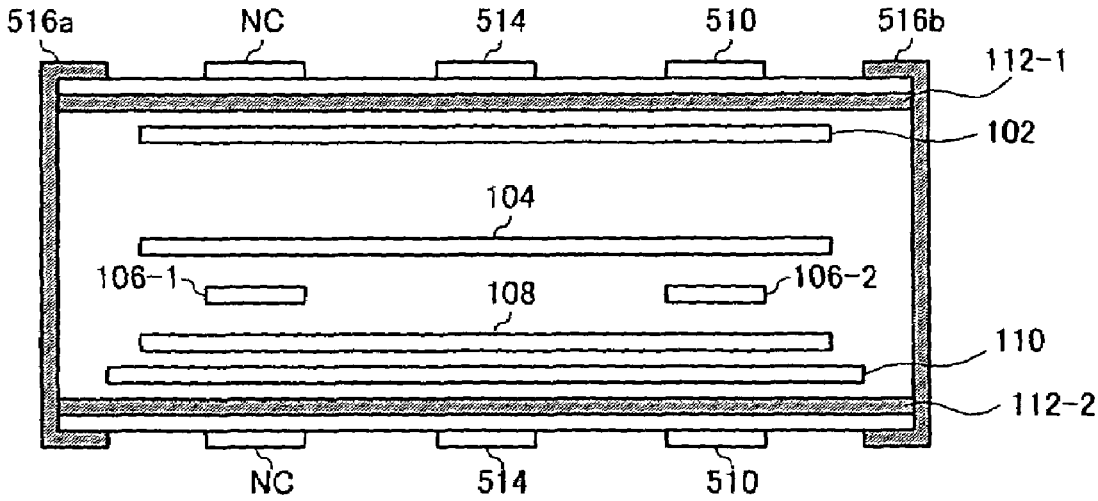
FIG. 8 is a sectional view, taken along line A-A', of the balanced filter shown in FIG. 7.

FIG. 8 is a sectional view, taken along line A-A', of the balanced filter shown in FIG. 7. As shown in FIG. 8, the balanced filter has a strip-line structure in which an unbalanced-side resonance electrode 102, a balanced-side resonance electrode 104, a stage constituting resonance electrode 108, and a DC electrode 110 are formed on respective dielectric layers in laminated arrangement between GND electrodes 112-1 and 112-2 which are connected respectively to the GND terminals 516*a*, 516*b*.

In that structure, the unbalanced-side resonance electrode 102 and the balanced-side resonance electrode 104 are formed in adjacently opposed relation with the dielectric layer interposed between them, and a balun section is constituted by coupling between those resonance electrodes.

Also, the balanced-side resonance electrode 104 and the stage constituting resonance electrode 108 are formed in adjacently opposed relation with the dielectric layer interposed between them, and coupling electrodes 106-1 and 106-2 are disposed between both the resonance electrodes. With such a structure, the balanced-side resonance electrode 104 and the stage constituting resonance electrode 108 are coupled to each other, thereby constituting a filter section.

Further, between the stage constituting resonance electrode 108 and the GND electrode 112-2, the DC electrode 110 connected to the DC terminal 514 is arranged and functions as a DC supply layer with capacitive coupling caused between the stage constituting resonance electrode 108 and the GND electrode 112-2.

Additionally, the unbalanced-side resonance electrode 102 is connected to the unbalanced terminal 510, and the balanced-side resonance electrode 104 is connected to the unbalanced terminals 512*a*, 512*b* shown in FIG. 7. The GND electrodes 112-1 and 112-2 are connected to the GND terminals 516*a*, 516*b* and 516*c*, and the DC electrode 110 is connected to the DC terminal 514.

Figure 9:
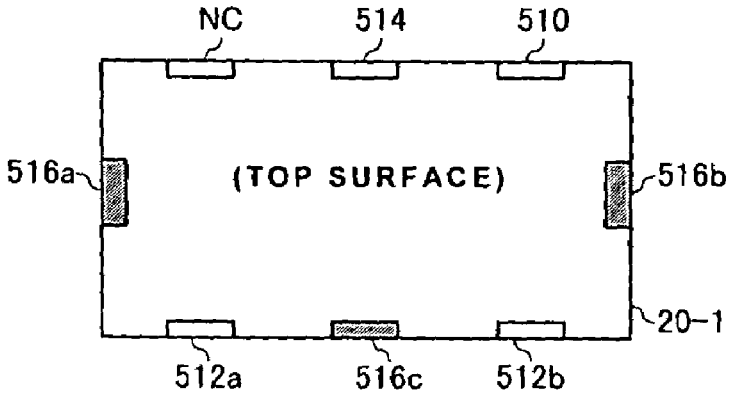
FIG. 9 is a first exploded plan view showing the arrangement of electrodes in layers of the balanced filter shown in FIG. 8.
Figure 9:
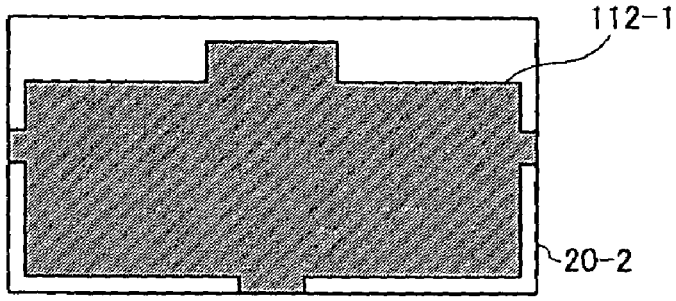

FIG. 9 is a first exploded plan view showing the arrangement of electrodes in layers of the balanced filter shown in FIG. 8. As shown at (a) in FIG. 9, the unconnected terminal NC, the DC terminal 514, the unbalanced terminal 510, the balanced terminals 512*a* and 512*b*, and the GND terminals 516*a*-516*c* are formed on a first dielectric layer 20-1, thereby constituting a top surface of the balanced filter.

Also, as shown at (b) in FIG. 9, the GND electrode 112-1 is formed on a second dielectric layer 20-2 in contact with the GND terminals 516*a*-516*c*, and the second dielectric layer 20-2 is arranged under the first dielectric layer 20-1 shown in FIG. 9(*a*).

Figure 10:
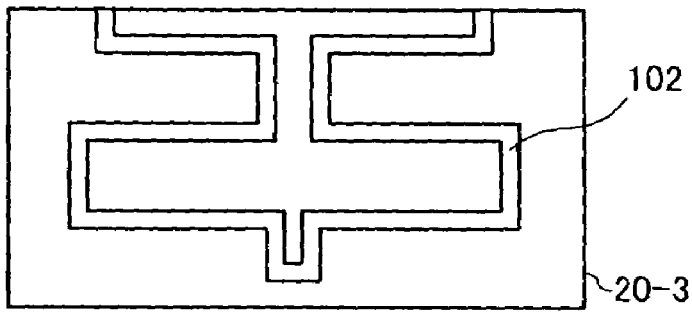
FIG. 10 is a second exploded plan view showing the arrangement of electrodes in layers of the balanced filter shown in FIG. 8.
Figure 10:
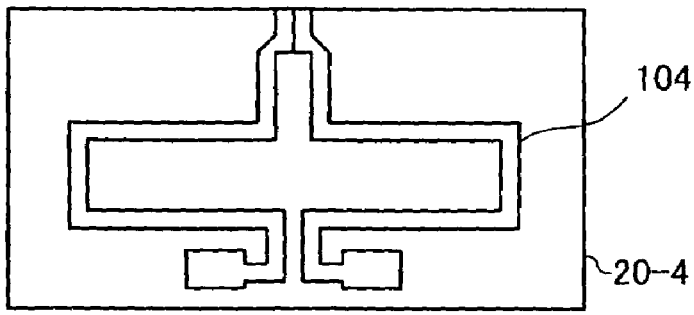

FIG. 10 is a second exploded plan view showing the arrangement of electrodes in layers of the balanced filter shown in FIG. 8. As shown at (a) in FIG. 10, the unbalanced-side resonance electrode 102 having a length of λ/2 is formed on a third dielectric layer 20-3 in junction with the NC terminal and the unbalanced terminal 510, and the third dielectric layer 20-3 is arranged under the second dielectric layer 20-2 shown in FIG. 9(*b*).

Also, as shown at (b) in FIG. 10, the balanced-side resonance electrode 104 made up of two strip-lines is formed on a fourth dielectric layer 20-4, each of the strip-lines being formed to extend in length of λ/4 from the DC terminal 514. The fourth dielectric layer 20-4 is arranged under the third dielectric layer 20-3 shown in FIG. 10(*a*).

Figure 11:
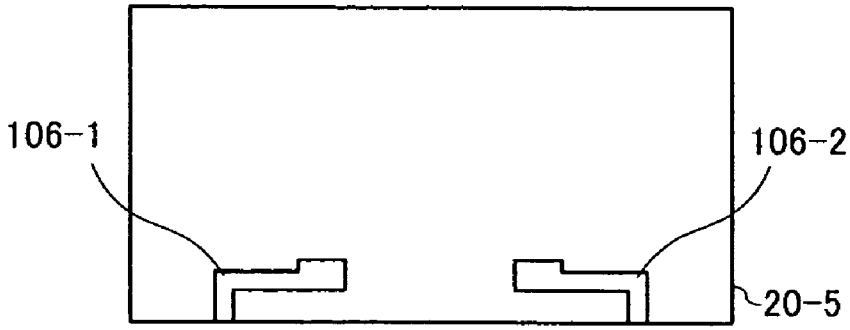
FIG. 11 is a third exploded plan view showing the arrangement of electrodes in layers of the balanced filter shown in FIG. 8.
Figure 11:
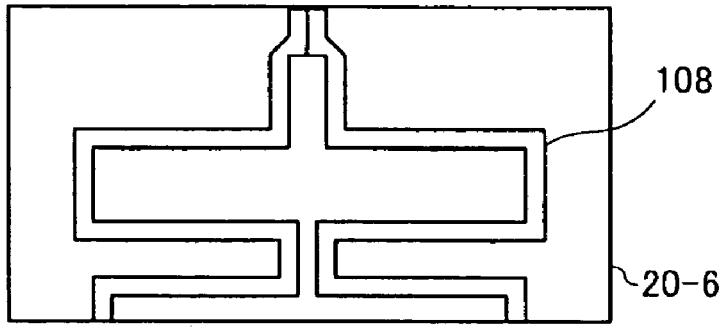

FIG. 11 is a third exploded plan view showing the arrangement of electrodes in layers of the balanced filter shown in FIG. 8. As shown at (a) in FIG. 11, the coupling electrodes 106-1 and 106-2 connected respectively to the balanced terminals 512*a* and 512*b* are formed on a fifth dielectric layer 20-5, and the fifth dielectric layer 20-5 is arranged under the fourth dielectric layer 20-4 shown in FIG. 10(*b*).

Also, as shown at (b) in FIG. 11, the stage constituting resonance electrode 108 made up of two strip-lines is formed on a sixth dielectric layer 20-6 in junction with the balanced terminals 512*a* and 512*b*, each of the strip-lines being formed to extend in length of λ/4±α from the DC terminal 514. The sixth dielectric layer 20-6 is arranged under the fifth dielectric layer 20-5 shown in FIG. 11(*a*).

Figure 12:
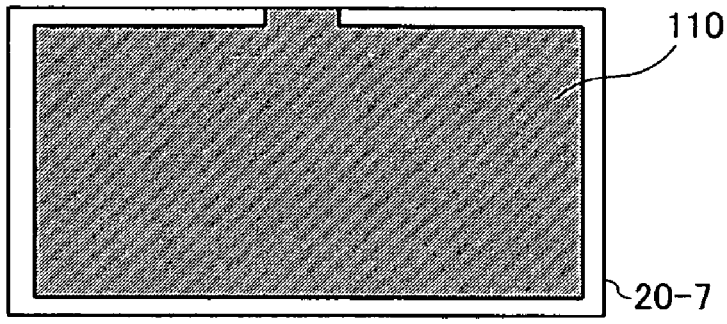
FIG. 12 is a fourth exploded plan view showing the arrangement of electrodes in layers of the balanced filter shown in FIG. 8.
Figure 12:
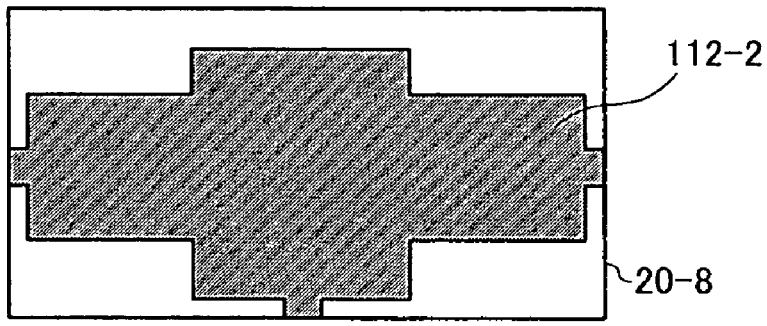

FIG. 12 is a fourth exploded plan view showing the arrangement of electrodes in layers of the balanced filter shown in FIG. 8. As shown at (a) in FIG. 12, the DC electrode 110 connected to the DC terminal 514 is formed on a seventh dielectric layer 20-7, and the seventh dielectric layer 20-7 is arranged under the sixth dielectric layer 20-6 shown in FIG. 11(*b*).

Also, as shown at (b) in FIG. 12, the GND electrode 112-2 connected to the GND terminals 516*a*-516*c* is formed on an eighth dielectric layer 20-8, and the eighth dielectric layer 20-8 is arranged under the seventh dielectric layer 20-7 shown in FIG. 12(*a*).

Figure 13:
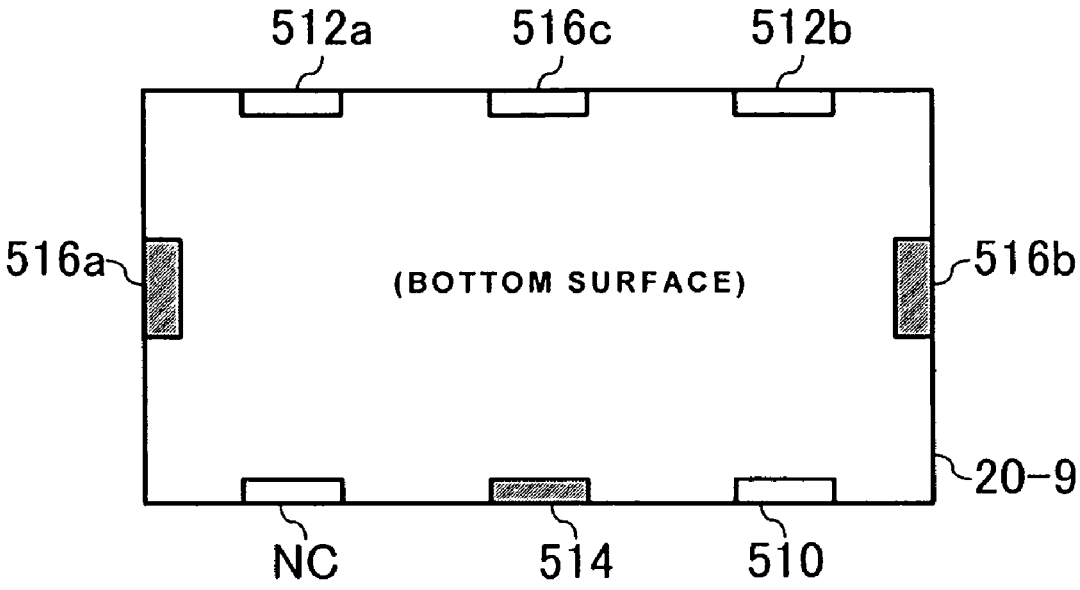
FIG. 13 is a fifth exploded plan view showing the arrangement of electrodes in a layer of the balanced filter shown in FIG. 8.

FIG. 13 is a fifth exploded plan view showing the arrangement of electrodes in a layer of the balanced filter shown in FIG. 8. As shown in FIG. 13, the balanced terminals 512*a* and 512*b*, the GND terminals 516*a*-516*c*, the unconnected terminal NC, the DC terminal 514, and the unbalanced terminal 510 are formed on a ninth dielectric layer 20-9, thereby constituting a bottom surface of the balanced filter. The ninth dielectric layer 20-9 is arranged under the eighth dielectric layer 20-8 shown in FIG. 12(*b*).

The above-mentioned dielectric layers 20-1 to 20-9 are formed into an integral structure through stacking and baking steps, thus completing the balanced filter in the laminated form made up of the plurality of dielectric layers. The external electrode terminals denoted by 510-516 in the drawings are preferably formed by coating or plating after the stacking and baking steps. Other suitable intermediate layers may be interposed between the dielectric layers 20-1 to 20-9, as required.

Figure 14:
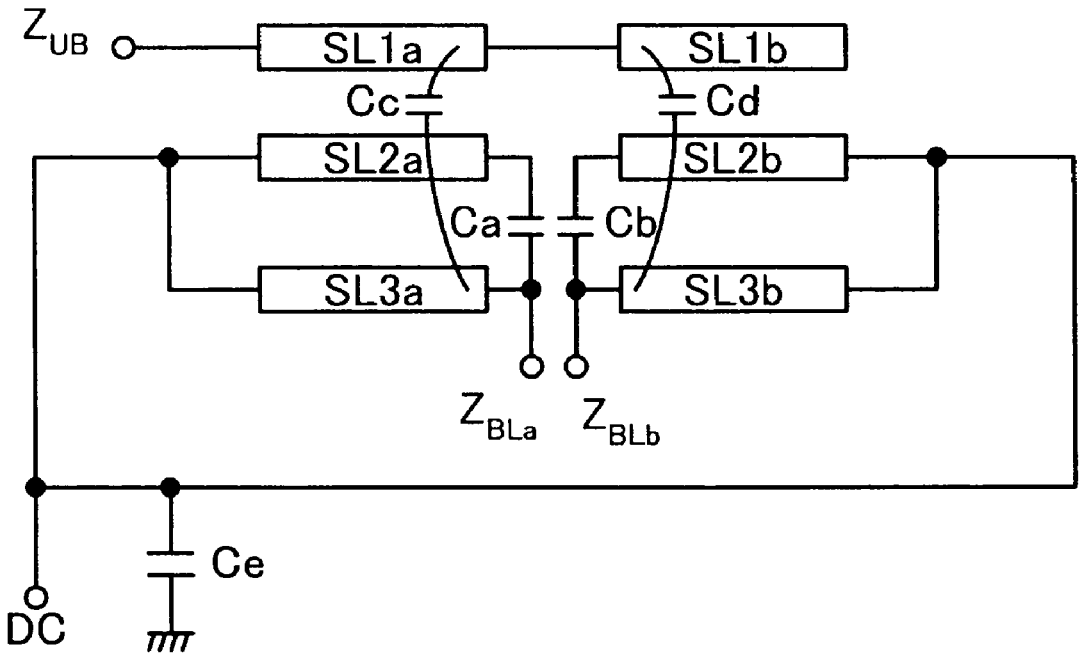
FIG. 14 is a circuit diagram showing an equivalent circuit of the balanced filter shown in FIG. 8.

FIG. 14 is a circuit diagram showing an equivalent circuit of the balanced filter shown in FIG. 8. In this balanced filter, as shown in FIG. 14, strip-line resonators SL1*a* and SL1*b* form the unbalanced-side resonance electrode 102, strip-line resonators SL2*a* and SL2*b* form the balanced-side resonance electrode 104, and strip-line resonators SL3*a* and SL3*b* form the stage constituting resonance electrode 108.

With the provision of the coupling electrodes 106-1 and 106-2, capacitive coupling components Ca and Cb are formed respectively between the balanced-side strip-lines SL2*a*, SL2*b* and the band control strip-lines SL3*a*, SL3*b*, and capacitive coupling components Cc and Cd are formed respectively between the unbalanced-side strip-lines SL1*a*, SL1*b* and the band control strip-lines SL3*a*, SL3*b*.

Also, with the provision of the DC electrode 110, a capacitive coupling component Ce is formed between the DC electrode 110 and the GND electrode 112-2, and this capacitive coupling component Ce functions as a capacitor for bypassing AC signals.

Figure 15:
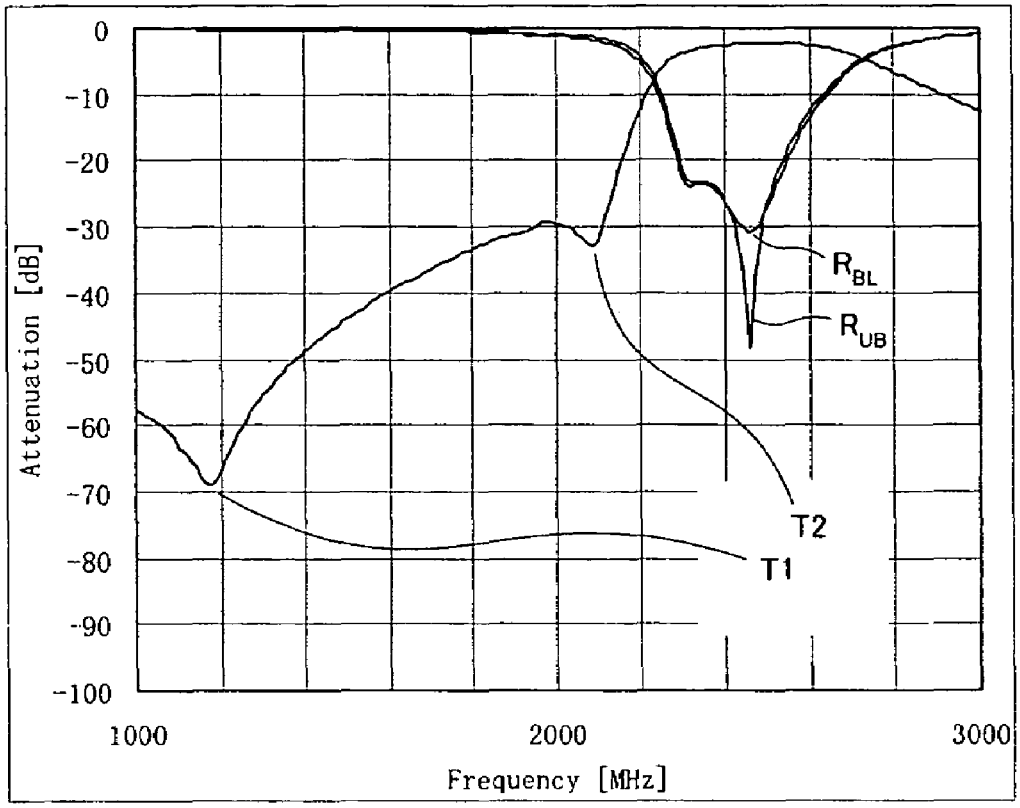
FIG. 15 is a characteristic graph showing attenuation and reflection characteristics of the balanced filter shown in FIG. 8.

FIG. 15 is a characteristic graph showing attenuation and reflection characteristics of the balanced filter shown in FIG. 8. As seen from FIG. 15, the attenuation characteristic of the balanced filter shown in FIG. 8 is given as a high-attenuation band passage characteristic having extremes T1 and T2. Further, a reflection characteristic $R_{UB}$ looking from the unbalanced side and a reflection characteristic $R_{BL}$ looking from the balanced side are each obtained as a good characteristic.

Figure 16:
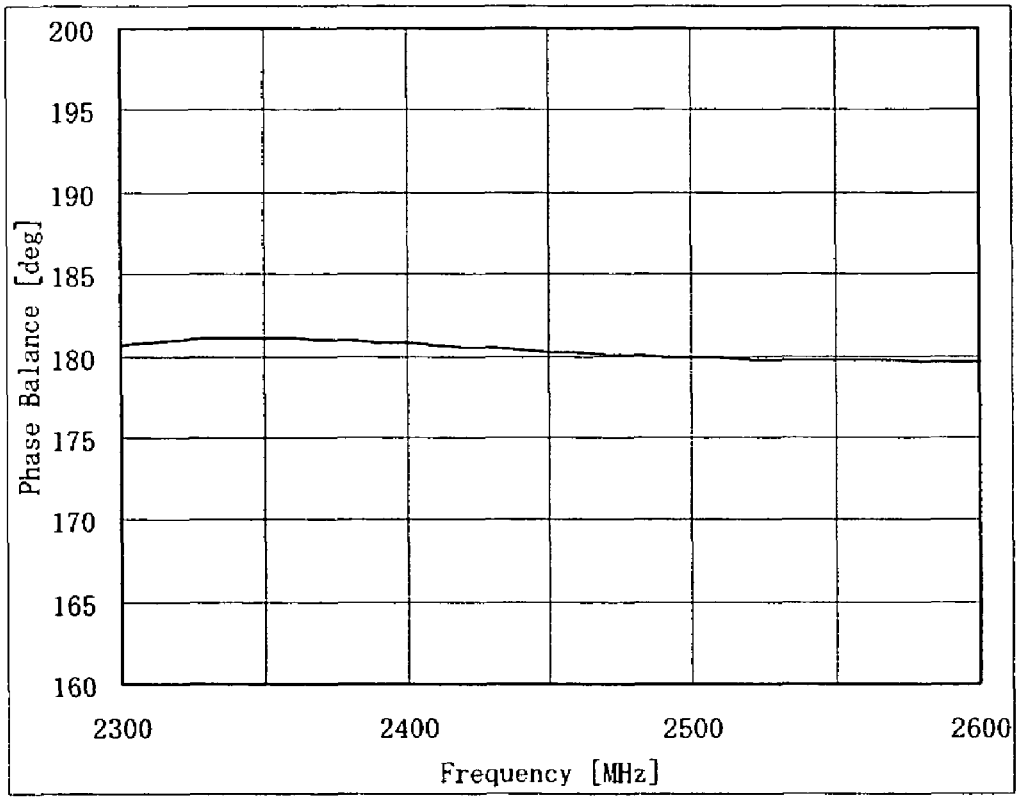
FIG. 16 is a characteristic graph showing phase balance of the balanced filter shown in FIG. 8.

FIG. 16 is a characteristic graph showing phase balance of the balanced filter shown in FIG. 8. As seen from FIG. 16, in the balanced filter shown in FIG. 8, good phase balance is obtained within the passage band.

Figure 17:
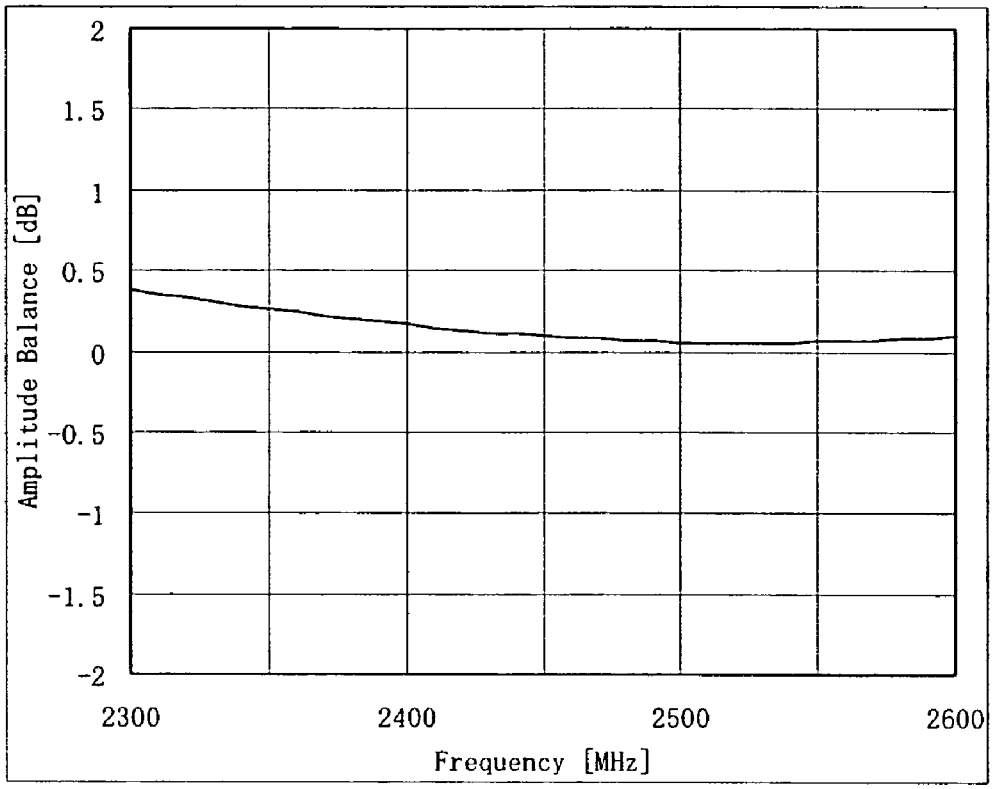
FIG. 17 is a characteristic graph showing amplitude balance of the balanced filter shown in FIG. 8.

FIG. 17 is a characteristic graph showing amplitude balance of the balanced filter shown in FIG. 8. As seen from FIG. 17, in the balanced filter shown in FIG. 8, good amplitude balance is obtained within the passage band.

Figure 18:
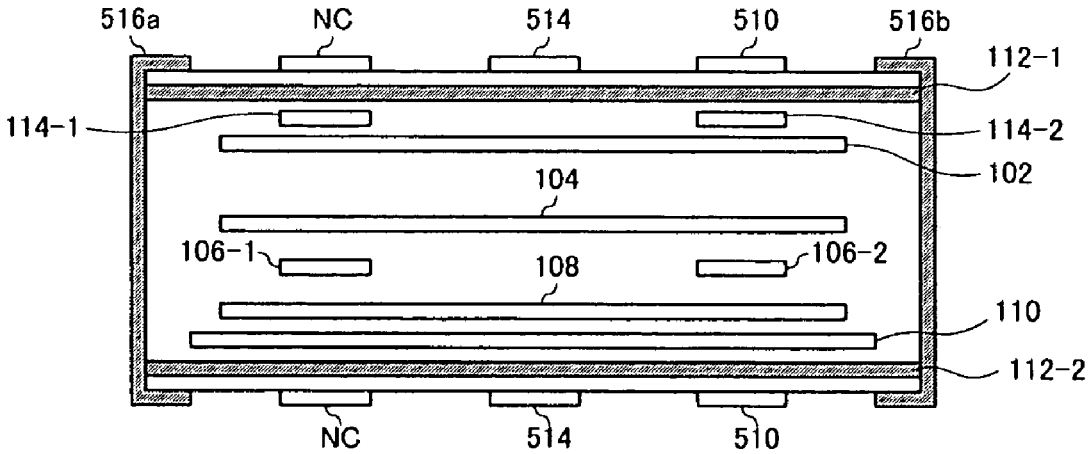
FIG. 18 is a sectional view showing a modification of the balanced filter shown in FIG. 8.

FIG. 18 is a sectional view showing a modification of the balanced filter shown in FIG. 8. In this modified balanced filter shown in FIG. 18, on the basis of the structure shown in FIG. 8, second coupling electrodes 114-1 and 114-2 are disposed between the GND electrode 112-1 and the unbalanced-side resonance electrode 102, and the balanced-side resonance electrode 104 and the stage constituting resonance electrode 108 are arranged in partly opposed relation. The other structure is the same as that of the balanced filter shown in FIG. 8.

Figure 19:
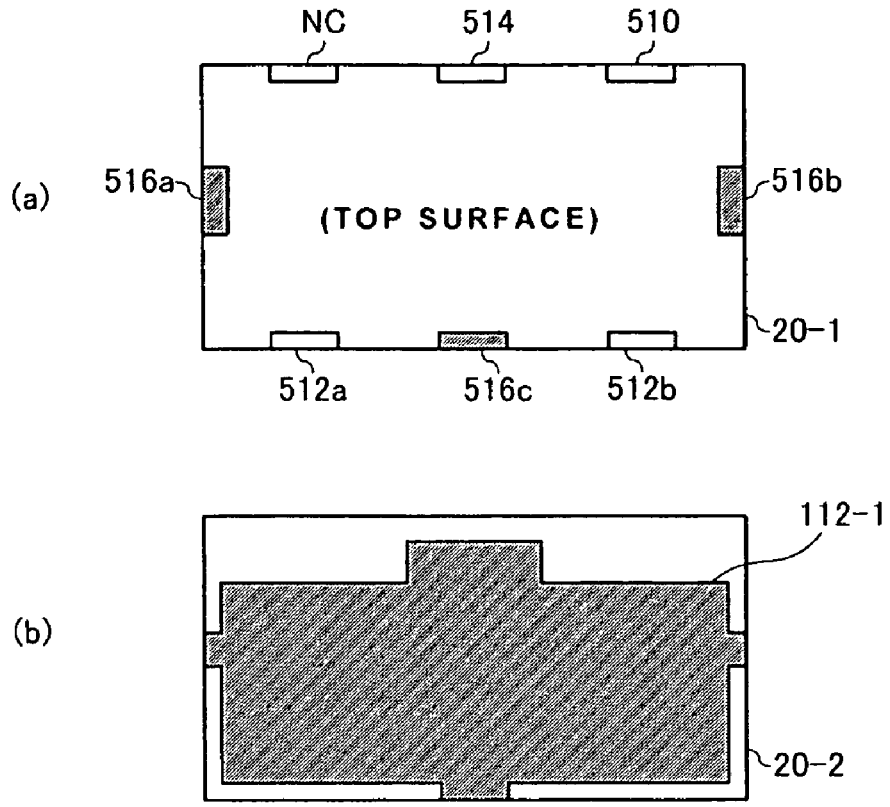
FIG. 19 is a first exploded plan view showing the arrangement of electrodes in layers of the balanced filter shown in FIG. 18.

FIG. 19 is a first exploded plan view showing the arrangement of electrodes in layers of the balanced filter shown in FIG. 18. As shown at (a) in FIG. 19, the unconnected terminal NC, the DC terminal 514, the unbalanced terminal 510, the balanced terminals 512*a* and 512*b*, and the GND terminals 516*a*-516*c* are formed on a first dielectric layer 20-1, thereby constituting a top surface of the modified balanced filter.

Also, as shown at (b) in FIG. 19, the GND electrode 112-1 is formed on a second dielectric layer 20-2 in contact with the GND terminals 516*a*-516*c*, and the second dielectric layer 20-2 is arranged under the first dielectric layer 20-1 shown in FIG. 19(*a*).

Figure 20:
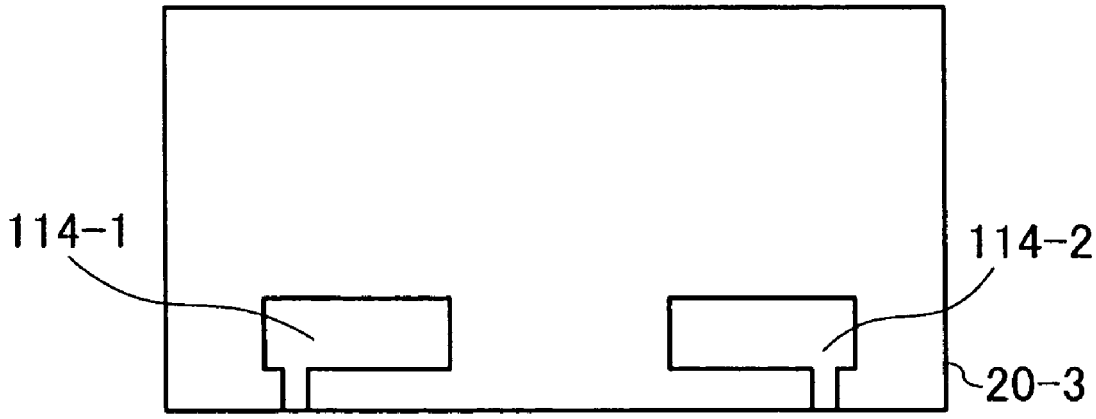
FIG. 20 is a second exploded plan view showing the arrangement of electrodes in a layer of the balanced filter shown in FIG. 18.

FIG. 20 is a second exploded plan view showing the arrangement of electrodes in a layer of the balanced filter shown in FIG. 18. As shown in FIG. 20, the second coupling electrodes 114-1 and 114-2 connected respectively to the balanced terminals 512*a* and 512*b* are formed on a third dielectric layer 20-3, and the third dielectric layer 20-3 is arranged under the second dielectric layer 20-2 shown in FIG. 19(*b*).

Figure 21:
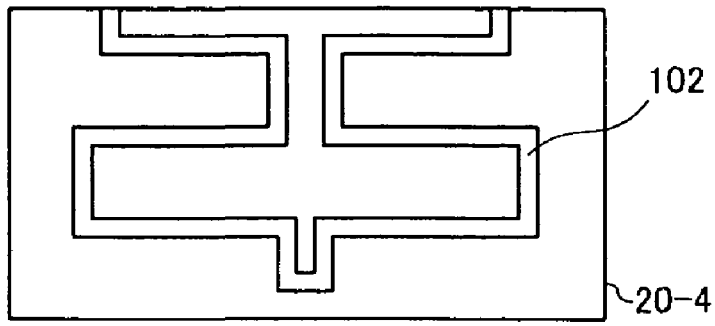
FIG. 21 is a third exploded plan view showing the arrangement of electrodes in layers of the balanced filter shown in FIG. 18.
Figure 21:
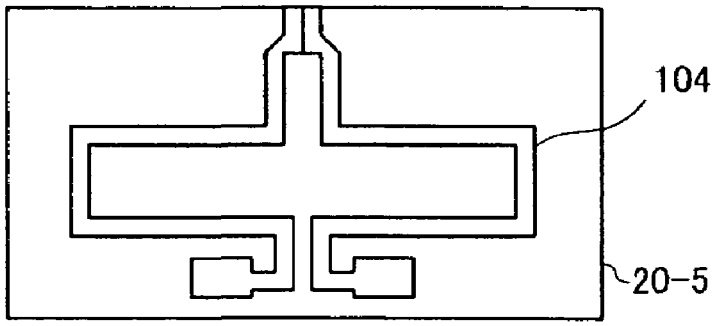

FIG. 21 is a third exploded plan view showing the arrangement of electrodes in layers of the balanced filter shown in FIG. 18. As shown at (a) in FIG. 21, the unbalanced-side resonance electrode 102 having a length of λ/2 is formed on a fourth dielectric layer 20-4 in junction with the NC terminal and the unbalanced terminal 510, and the fourth dielectric layer 20-4 is arranged under the third dielectric layer 20-3 shown in FIG. 20.

Also, as shown at (b) in FIG. 21, the balanced-side resonance electrode 104 made up of two strip-lines is formed on a fifth dielectric layer 20-5, each of the strip-lines being formed to extend in length of λ/4 from the DC terminal 514. The fifth dielectric layer 20-5 is arranged under the fourth dielectric layer 20-4 shown in FIG. 21(*a*).

Figure 22:
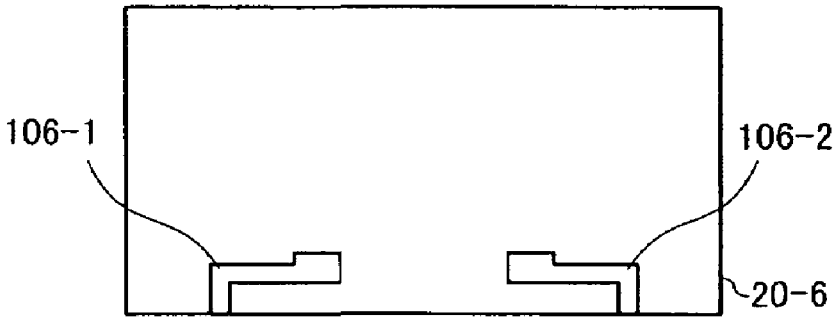
FIG. 22 is a fourth exploded plan view showing the arrangement of electrodes in layers of the balanced filter shown in FIG. 18.
Figure 22:
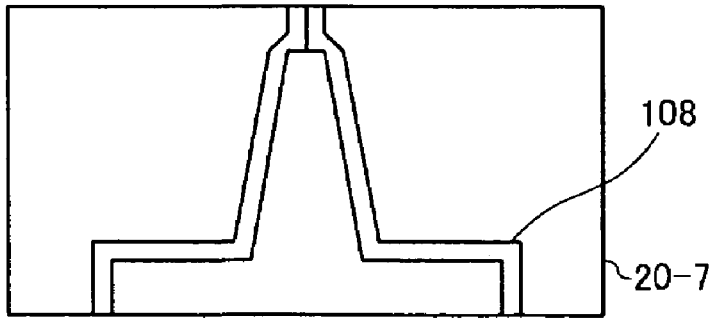

FIG. 22 is a fourth exploded plan view showing the arrangement of electrodes in layers of the balanced filter shown in FIG. 18. As shown at (a) in FIG. 22, the coupling electrodes 106-1 and 106-2 connected respectively to the balanced terminals 512*a* and 512*b* are formed on a sixth dielectric layer 20-6, and the sixth dielectric layer 20-6 is arranged under the fifth dielectric layer 20-5 shown in FIG. 21(*b*).

Also, as shown at (b) in FIG. 22, the stage constituting resonance electrode 108 made up of two strip-lines is formed on a seventh dielectric layer 20-7 in junction with the balanced terminals 512*a* and 512*b*, each of the strip-lines being formed to extend in length of λ/4±α from the DC terminal 514. The seventh dielectric layer 20-7 is arranged under the sixth dielectric layer 20-6 shown in FIG. 22(*a*). The stage constituting resonance electrode 108 and the balanced-side resonance electrode 104 are formed in laminated arrangement in partly opposed relation.

Figure 23:
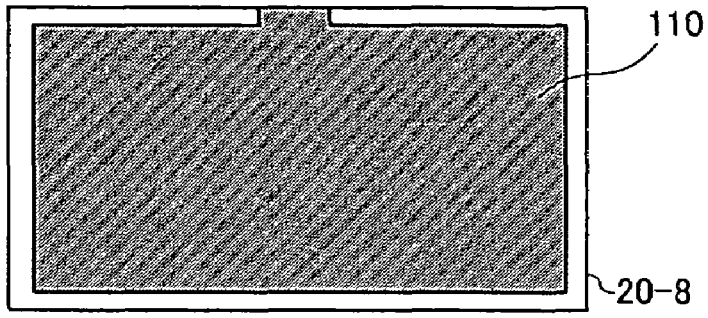
FIG. 23 is a fifth exploded plan view showing the arrangement of electrodes in a layer of the balanced filter shown in FIG. 18.
Figure 23:
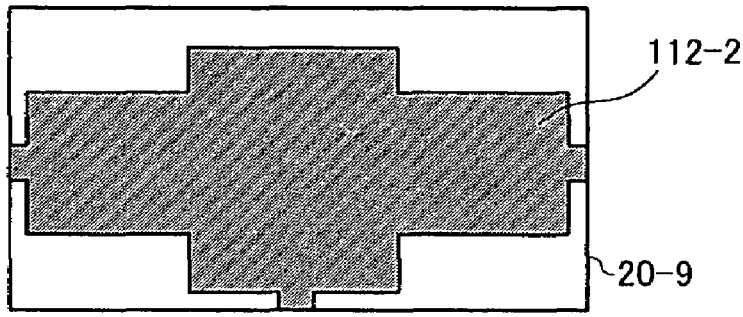

FIG. 23 is a fifth exploded plan view showing the arrangement of electrodes in layers of the balanced filter shown in FIG. 18. As shown at (a) in FIG. 23, the DC electrode 110 connected to the DC terminal 514 is formed on an eighth dielectric layer 20-8, and the eighth dielectric layer 20-8 is arranged under the seventh dielectric layer 20-7 shown in FIG. 22(*b*).

Also, as shown at (b) in FIG. 23, the GND electrode 112-2 connected to the GND terminals 516*a*-516*c* is formed on a ninth dielectric layer 20-9, and the ninth dielectric layer 20-9 is arranged under the eighth dielectric layer 20-8 shown in FIG. 23(*a*).

Figure 24:
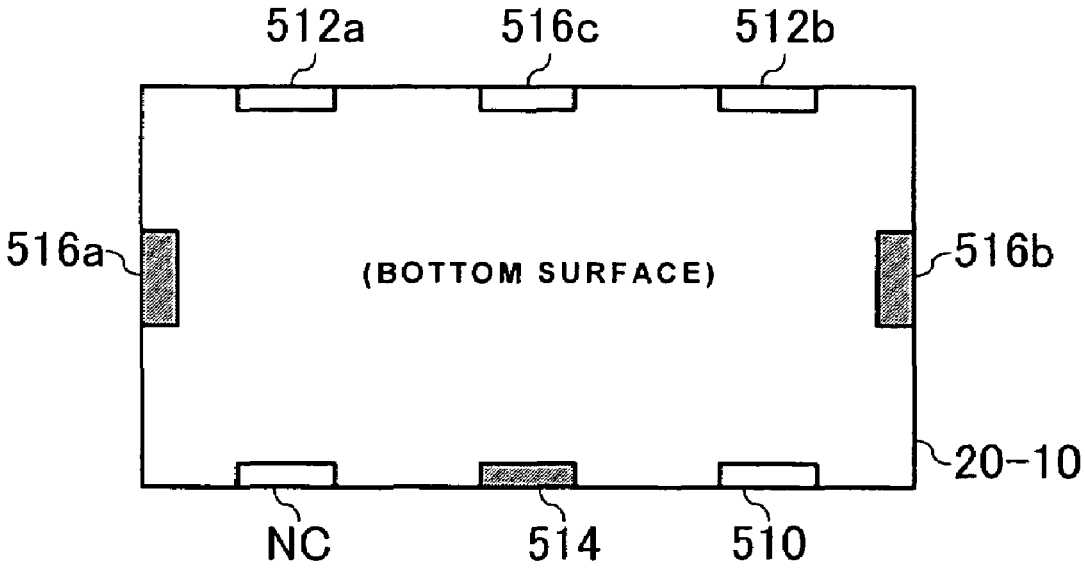
FIG. 24 is a sixth exploded plan view showing the construction of electrodes in a layer of the balanced filter shown in FIG. 18.

FIG. 24 is a sixth exploded plan view showing the arrangement of electrodes in a layer of the balanced filter shown in FIG. 18. As shown in FIG. 24, the balanced terminals 512*a* and 512*b*, the GND terminals 516*a*-516*c*, the unconnected terminal NC, the DC terminal 514, and the unbalanced terminal 510 are formed on a tenth dielectric layer 20-10, thereby constituting a bottom surface of the modified balanced filter. The tenth dielectric layer 20-10 is arranged under the ninth dielectric layer 20-9 shown in FIG. 23(*b*).

The dielectric layers 20-1 to 20-10 are formed into an integral structure through stacking and baking steps, thus completing the balanced filter in the laminated form made up of the plurality of dielectric layers. The external electrode terminals denoted by 510-516 in the drawings are preferably formed by coating or plating after the stacking and baking steps. Other suitable intermediate layers may be interposed between the dielectric layers 20-1 to 20-10, as required.

Another embodiment of the present invention will be described in detail below with reference to the accompanying drawings. Note that the present invention is not limited to the following embodiment and can be modified as required.

Figure 25:
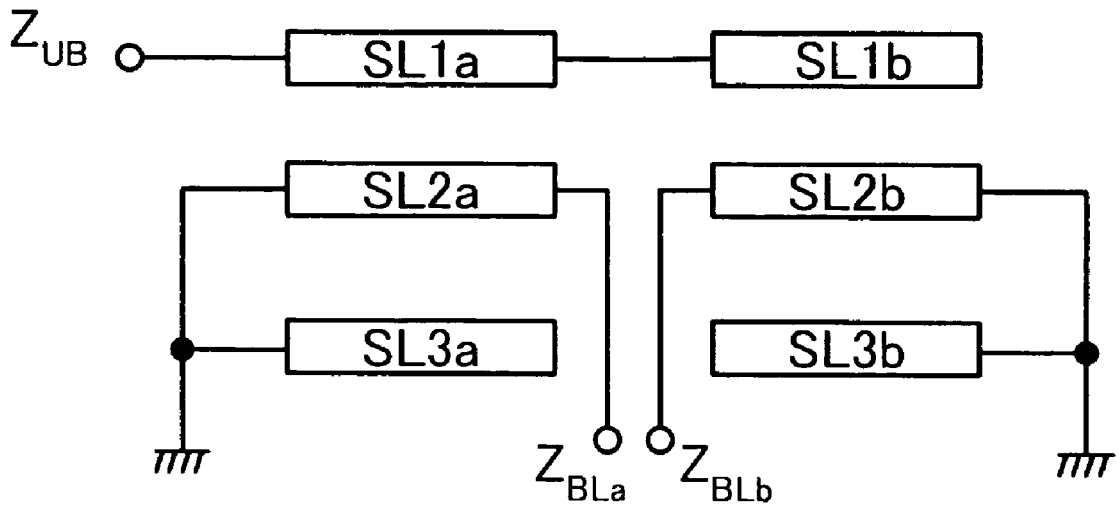
FIG. 25 is an equivalent circuit diagram showing features of a balanced filter according to another embodiment.

FIG. 25 is an equivalent circuit diagram showing features of a balanced filter according to another embodiment. As shown in FIG. 25, the balanced filter according to this embodiment comprises strip-line resonators SL1*a* and SL1*b* constituting resonance electrodes on the unbalanced side, strip-line resonators SL2*a* and SL2*b* constituting resonance electrodes on the balanced side, and strip-line resonator SL3*a* and SL3*b* constituting stage constituting resonance electrodes which are shorted at one ends and opened at the other ends thereof.

The unbalanced-side resonance electrodes SL1*a* and SL1*b* are each formed of a λ/4 strip-line. As shown in FIG. 25, those strip-lines are connected to each other at their one ends. Then, the other end of the unbalanced-side resonance electrode SL1*a* is connected to an unbalanced terminal $Z_{UB}$, and the other end of the unbalanced-side resonance electrode SL1*b* is constituted as an open end.

The balanced-side resonance electrodes SL2*a* and SL2*b* are each formed of a λ/4 strip-line shorted at one end. As shown in FIG. 25, the balanced-side resonance electrodes SL2*a* and SL2*b* are arranged adjacent to the unbalanced-side resonance electrodes SL1*a*and SL1*b*, respectively, and their open ends are connected to balanced terminals $Z_{BLa}$ and $Z_{BLb}$.

The band control resonance electrodes SL3*a* and SL3*b* are each formed of a strip-line shorted at one end and left open at the other end. As shown in FIG. 25, the band control resonance electrodes SL3*a* and SL3*b* are arranged adjacent to the balanced-side resonance electrodes SL2*a* and SL2*b*, respectively. Each of these band control resonance electrodes SL3*a* and SL3*b* has a length adjusted on the basis of λ/4.

The balanced-side resonance electrodes SL2*a* and SL2*b* and the band control resonance electrodes SL3*a* and SL3*b* may be constituted in comb-line arrangement in which the shorted ends of the resonators are laid to face in the same direction, or in interdigital arrangement in which the shorted ends of the resonators are laid to face in opposed directions.

With that construction, electromagnetic coupling occurs between one resonator and another resonator adjacent to it. Consequently, a balun section is formed by mutual coupling between the unbalanced-side resonance electrodes SL1*a*, SL1*b* and the balanced-side resonance electrodes SL2*a*, SL2*b*, while a filter section is formed by mutual coupling between the balanced-side resonance electrodes SL2*a*, SL2*b* and the band control resonance electrodes SL3*a*, SL3*b*.

As a result, the balun function and the filter function can be obtained with the structure in which the balanced-side resonance electrodes SL2*a* and SL2*b* are shared by the balun section and the filter section. Hence, the balanced filter having a simple structure, a small size and a low cost can be realized.

Figure 26:
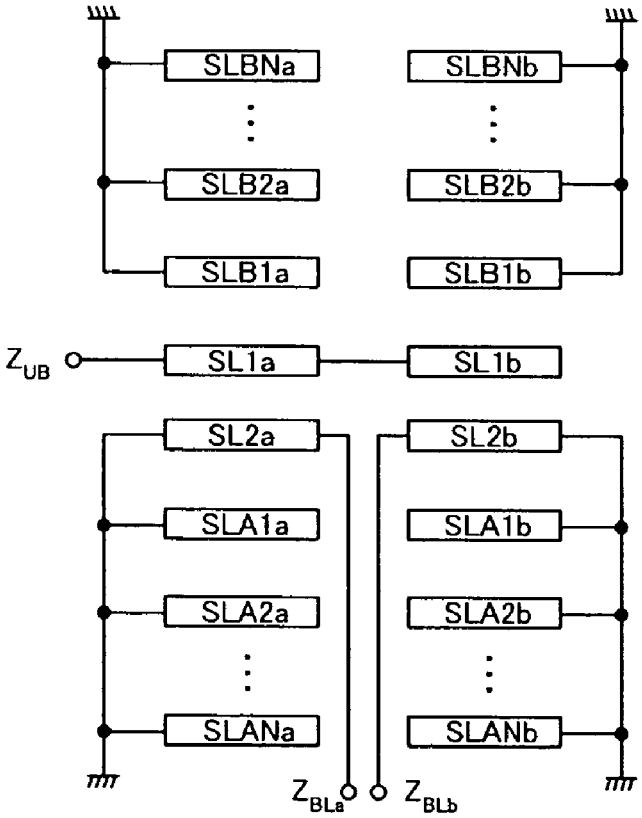
FIG. 26 is an equivalent circuit diagram showing an example in which the balanced filter shown in FIG. 25 is constructed in multiple stages.

FIG. 26 is an equivalent circuit diagram showing an example in which the balanced filter shown in FIG. 25 is constructed in multiple stages. When it is desired to enhance the filter function of the balanced filter shown in FIG. 25, band control resonance electrodes SLA1*a*, SLA1*b*-SLANa, SLANb may be added in multistage arrangement, as shown in FIG. 26, on the side adjacent to the balanced-side resonance electrodes. As an alternative, band control resonance electrodes SLB1*a*, SLB1*b*-SLBNa, SLBNb may be added in multistage arrangement on the side adjacent to the unbalanced-side resonance electrodes.

Figure 27:
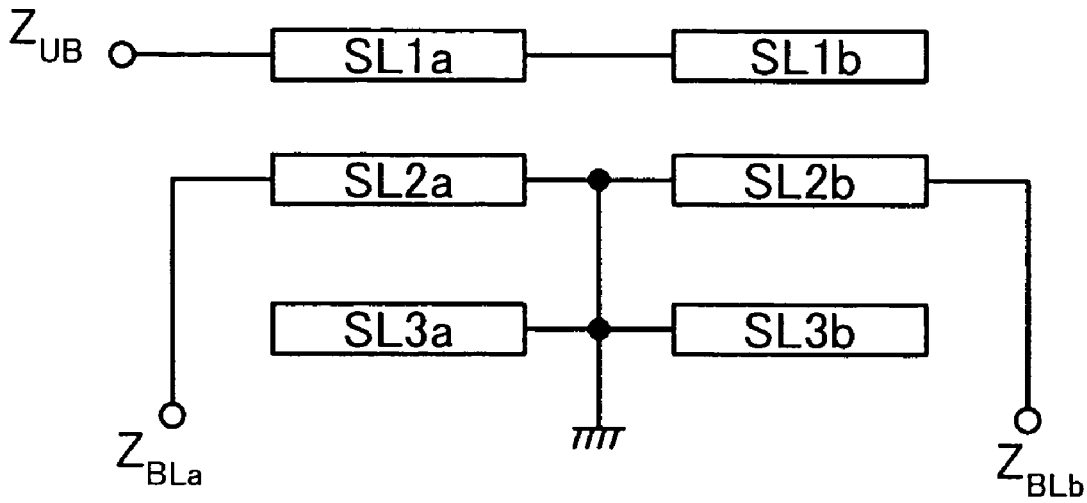
FIG. 27 is an equivalent circuit diagram showing an example in which a shorted end and an open end of the balanced filter shown in FIG. 25 are changed in directions to face.

FIG. 27 is an equivalent circuit diagram showing an example in which a shorted end and an open end of the balanced filter shown in FIG. 25 are changed in directions to face. As shown in FIG. 27, the balanced-side resonance electrodes SL2*a* and SL2*b* may be shorted at the junction between them, and the open ends of those resonance electrodes SL2*a* and SL2*b* may be connected to balanced terminals $Z_{BLa}$ and $Z_{BLb}$, respectively. In this case, preferably, the band control resonance electrodes SL3*a* and SL3*b* are also shorted at the junction between them corresponding to the balanced-side resonance electrodes.

Figure 28:
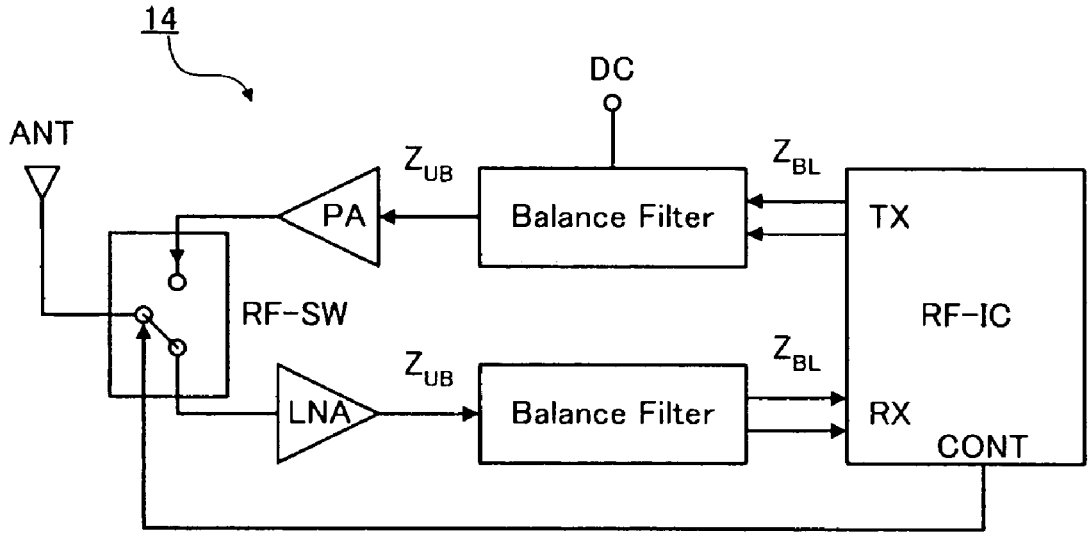
FIG. 28 is a circuit block diagram showing the configuration of an RF front end section in which the balanced filter according to another embodiment is assembled.

FIG. 28 is a circuit block diagram showing the configuration of an RF front end section in which the balanced filter according to another embodiment is assembled. In a radio communication circuit 14 shown in FIG. 28, the balanced filter is assembled in each of a transmitting path TX and a receiving path RX, and DC power is supplied to the balanced filter arranged on the transmitting path TX side.

As shown in FIG. 28, the radio communication circuit 14 comprises an antenna (ANT) for transmitting and receiving electric waves, an RF switch (RF-SW) for switching over the transmitting path TX and the receiving path RX, a power amplifier (PA) for amplifying a signal in the transmitting path TX, a low-noise amplifier (LNA) for amplifying a signal in the receiving path RX, the balanced filter disposed in each of the transmitting path TX and the receiving path RX, and an integrated circuit (RF-IC) for generating and processing an RF signal. The switching between the transmitting path TX and the receiving path RX is performed in response to a signal outputted from a control port (CONT) of the integrated circuit (RF-IC).

A signal received by the antenna (ANT) is inputted to the balanced filter in the form of an unbalanced signal on the basis of the GND potential via the RF switch (RF-SW) and the low-noise amplifier (LNA). The balanced filter converts the unbalanced signal to the balanced signal having a phase difference of 180°, and the converted balanced signal is inputted to a receiving port RX of the integrated circuit (RF-IC).

On the other hand, a transmission signal generated from the integrated circuit (RF-IC) is inputted in the form of a balanced signal to the transmitting-side balanced filter from a transmitting port TX. The transmitting-side balanced filter converts the balanced signal to an unbalanced signal with a DC bias applied to the balanced terminal. The converted unbalanced signal is radiated from the antenna (ANT) via the power amplifier (PA) and the RF switch (RF-SW).

While the example shown in FIG. 28 has been described as adding a DC signal to the balun disposed in the transmitting path TX, the DC signal may be added to the receiving path RX side depending on the specification of the radio communication circuit. Alternatively, the circuit configuration may be modified such that the DC signal is not added to both the transmitting and receiving paths.

Figure 29:
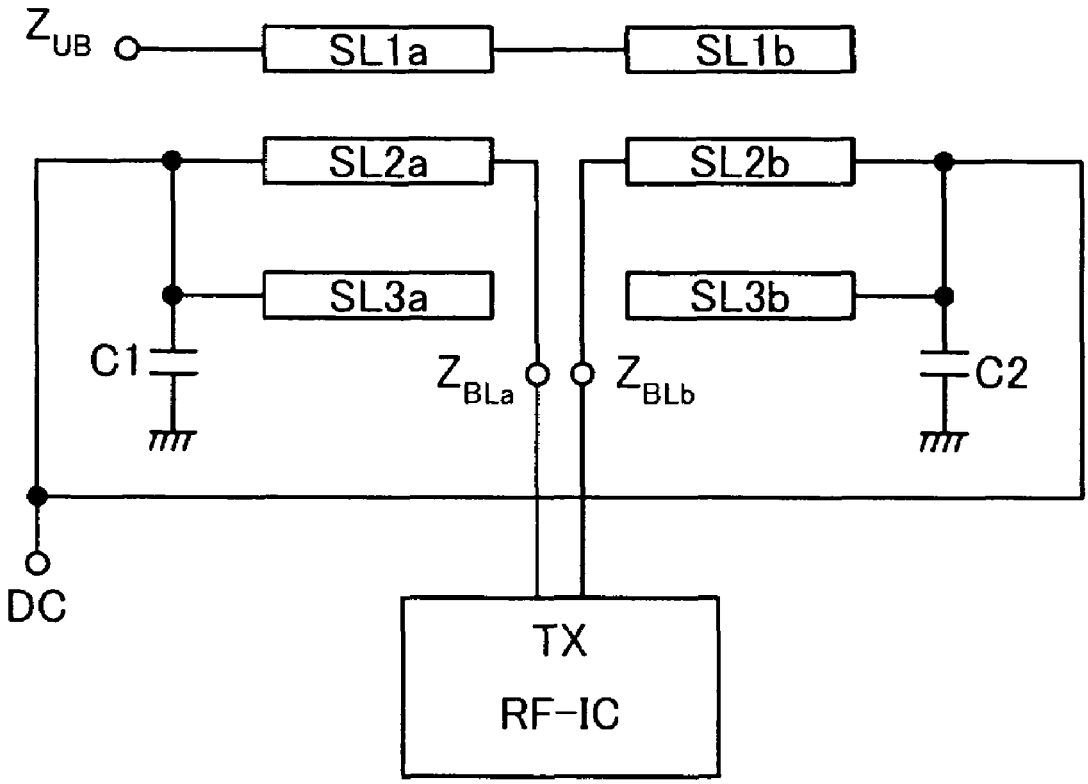
FIG. 29 is a circuit block diagram showing an equivalent circuit of a transmitting-side balanced filter shown in FIG. 28.

FIG. 29 is a circuit block diagram showing an equivalent circuit of the transmitting-side balanced filter shown in FIG. 28. As shown in FIG. 29, the transmitting-side balanced filter supplied with the DC signal comprises strip-line resonators SL1*a* and SL1*b* constituting resonance electrodes on the unbalanced side, strip-line resonators SL2*a* and SL2*b* constituting resonance electrodes on the balanced side, resonance electrodes SL3*a* and SL3*b* for band control, and capacitors C1 and C2 for bypassing AC signals. Then, the transmitting-side balanced filter is connected at the unbalanced terminal side to the power amplifier (PA), shown in FIG. 28, via an unbalanced terminal $Z_{UB}$, and is connected at the balanced terminal side to the integrated circuit (RF-IC) via balanced terminals $Z_{BLa}$ and $Z_{BLb}$.

Figure 30:
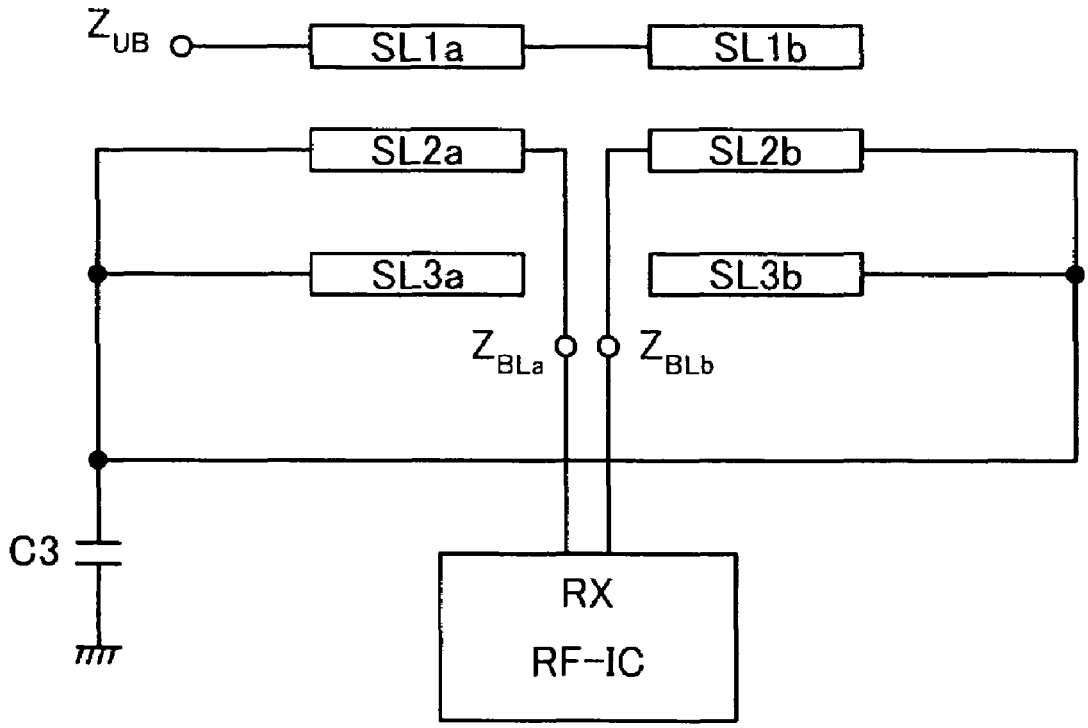
FIG. 30 is a circuit block diagram showing an equivalent circuit of a receiving-side balanced filter shown in FIG. 28.

FIG. 30 is a circuit block diagram showing an equivalent circuit of the receiving-side balanced filter shown in FIG. 28. As shown in FIG. 30, the receiving-side balanced filter is constituted such that the DC supply section is omitted from the transmitting-side balanced filter shown in FIG. 29 and a capacitor C3 for adjusting characteristics is disposed instead of the capacitors C1 and C2 for bypassing AC signals.

Figure 31:
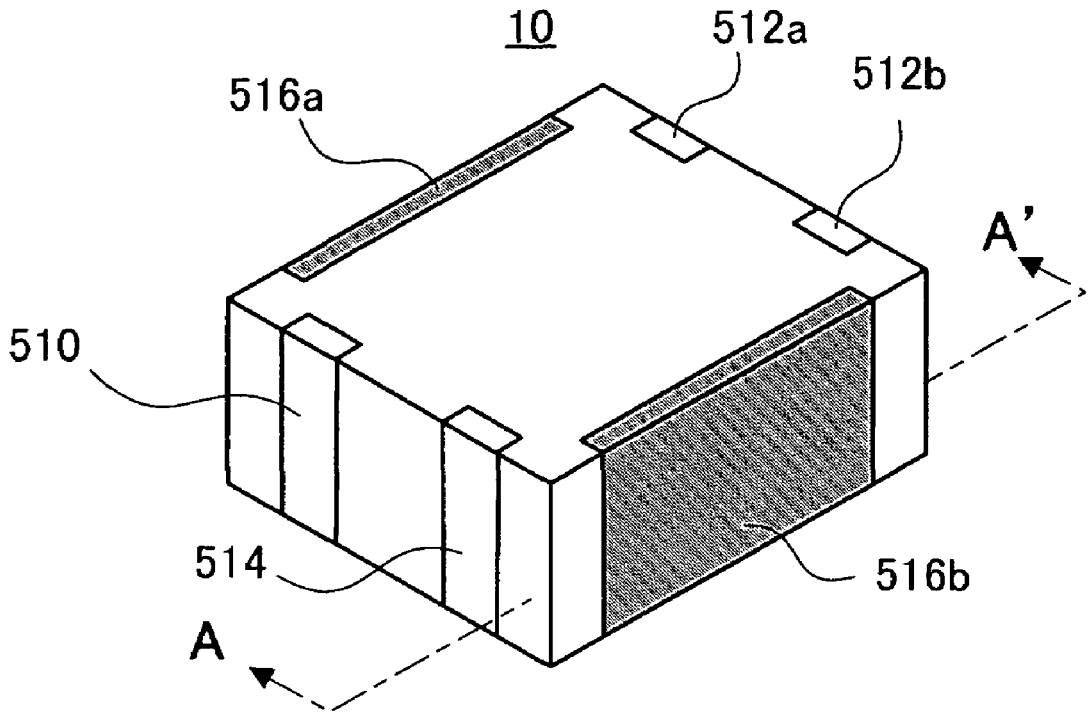
FIG. 31 is a perspective view showing, in external appearance, the structure of the balanced filter according to another embodiment.

FIG. 31 is a perspective view showing, in external appearance, the structure of the balanced filter according to one embodiment. As shown in FIG. 31, a balanced filter 10 of this embodiment has, as external terminal electrodes, an unbalanced terminal 510, balanced terminals 512*a* and 512*b*, a DC terminal 514, and GND terminals 516*a* and 516*b*.

Figure 32:
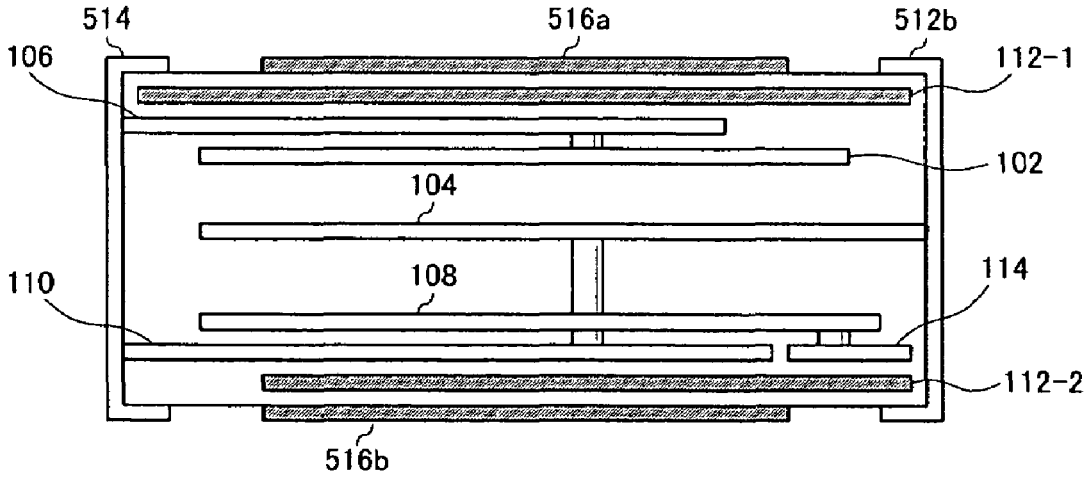
FIG. 32 is a sectional view, taken along line A-A', of the balanced filter shown in FIG. 31.

FIG. 32 is a sectional view, taken along line A-A', of the balanced filter shown in FIG. 31. As shown in FIG. 32, the balanced filter has a strip-line structure in which an unbalanced-side resonance electrode 102, a balanced-side resonance electrode 104, a stage constituting resonance electrode 108, and a DC electrode 110 are formed on respective dielectric layers in laminated arrangement between GND electrodes 112-1 and 112-2 which are connected respectively to the GND terminals 516*a*, 516*b*.

In that structure, the unbalanced-side resonance electrode 102 and the balanced-side resonance electrode 104 are formed in adjacently opposed relation with the dielectric layer interposed between them, and a balun section is constituted by coupling between those resonance electrodes.

Also, the balanced-side resonance electrode 104 and the stage constituting resonance electrode 108 are formed in adjacently opposed relation with the dielectric layer interposed between them, and a filter section is constituted by coupling between those resonance electrodes. A wavelength shortening electrode 114 capacitively coupled to the GND electrode 112-1 is connected to the stage constituting resonance electrode 108.

Further, between the stage constituting resonance electrode 108 and the GND electrode 112-2, the DC electrode 110 connected to the DC terminal 514 is arranged and functions as a DC supply layer with capacitive coupling caused between the DC electrode 110 and the GND electrode 112-2.

Additionally, the unbalanced-side resonance electrode 102 is connected to the unbalanced terminal 510, and the balanced-side resonance electrode 104 is connected to the unbalanced terminals 512*a*, 512*b* shown in FIG. 31. The GND electrodes 112-1 and 112-2 are connected to the GND terminals 516*a* and 516*b*, and the DC electrode 110 is connected to the DC terminal 514.

Figure 33:
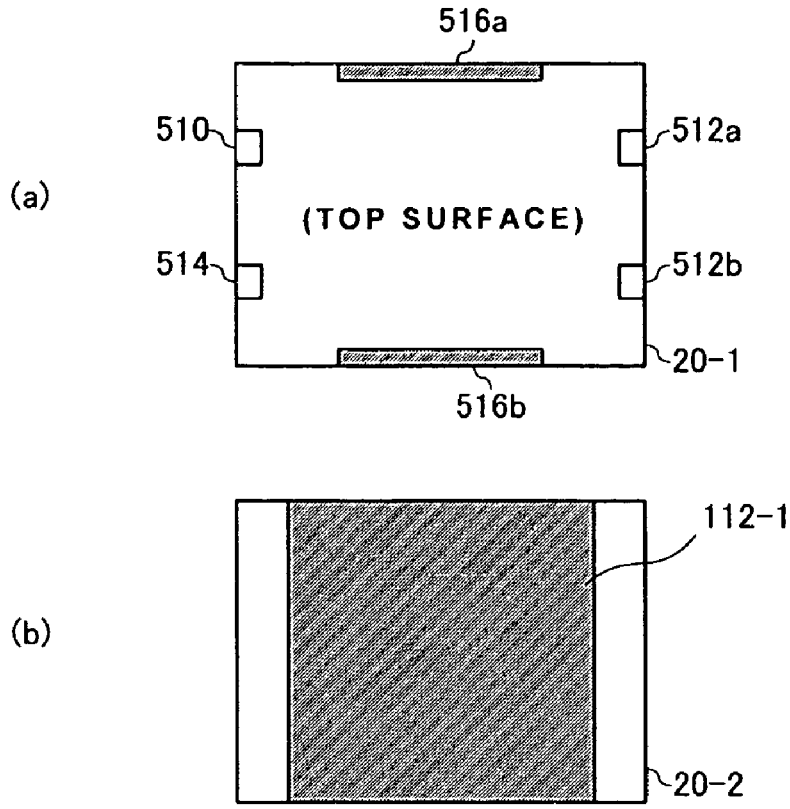
FIG. 33 is a first exploded plan view showing the arrangement of electrodes in layers of the balanced filter shown in FIG. 32.

FIG. 33 is a first exploded plan view showing the arrangement of electrodes in layers of the balanced filter shown in FIG. 32. As shown at (a) in FIG. 33, the unconnected terminal NC, the DC terminal 514, the unbalanced terminal 510, the balanced terminals 512*a* and 512*b*, and the GND terminals 516*a* and 516*b* are formed on a first dielectric layer 20-1, thereby constituting a top surface of the balanced filter.

Also, as shown at (b) in FIG. 33, the GND electrode 112-1 is formed on a second dielectric layer 20-2 in contact with the GND terminals 516*a* and 516*b*, and the second dielectric layer 20-2 is arranged under the first dielectric layer 20-1 shown in FIG. 33(*a*).

Figure 34:
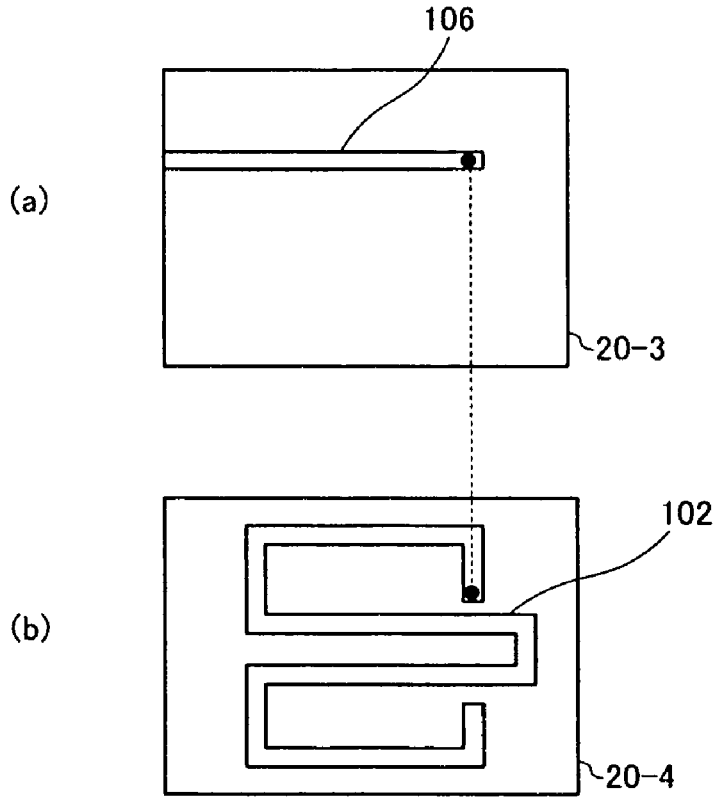
FIG. 34 is a second exploded plan view showing the arrangement of electrodes in layers of the balanced filter shown in FIG. 32.

FIG. 34 is a second exploded plan view showing the arrangement of electrodes in layers of the balanced filter shown in FIG. 32. As shown at (a) in FIG. 34, an input/output electrode 106 connected to the unbalanced terminal 512 is formed on a third dielectric layer 20-3, and the third dielectric layer 20-3 is arranged under the second dielectric layer 20-2 shown in FIG. 33(*b*).

Also, as shown at (b) in FIG. 34, the unbalanced-side resonance electrode 102 having a length of $\lambda/2$ is formed on a fourth dielectric layer 20-4 in junction with the input/output electrode 106, shown in FIG. 34(*a*), through a via, and the fourth dielectric layer 20-4 is arranged under the third dielectric layer 20-3 shown in FIG. 34(*a*). In FIG. 34, a connecting path formed by the via is indicated by a dotted line, and a connection point through the via is indicated by a black point (this is similarly applied to the following description).

Figure 35:
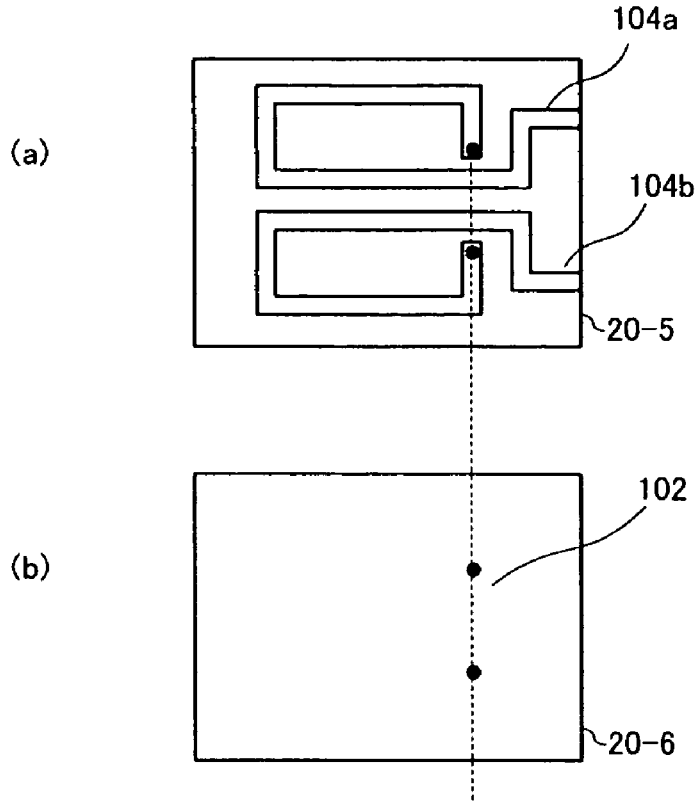
FIG. 35 is a third exploded plan view showing the arrangement of electrodes in layers of the balanced filter shown in FIG. 32.

FIG. 35 is a third exploded plan view showing the arrangement of electrodes in layers of the balanced filter shown in FIG. 32. As shown at (a) in FIG. 35, the balanced-side resonance electrode 104 made up of two strip-lines 104*a* and 104*b* is formed on a fifth dielectric layer 20-5, the strip-lines 104*a* and 104*b* being formed to extend in length of $\lambda/4$ from the balanced terminals 512*a* and 512*b*, respectively. The fifth dielectric layer 20-5 is arranged under the fourth dielectric layer 20-4 shown in FIG. 34(*b*).

Also, as shown at (b) in FIG. 35, vias for connecting the balanced-side resonance electrode 104 shown in FIG. 35(*a*) and the DC electrode 110 (described later) are formed in a sixth dielectric layer 20-6, and the sixth dielectric layer 20-6 is arranged under the fifth dielectric layer 20-5 shown in FIG. 35(*a*).

Figure 36:
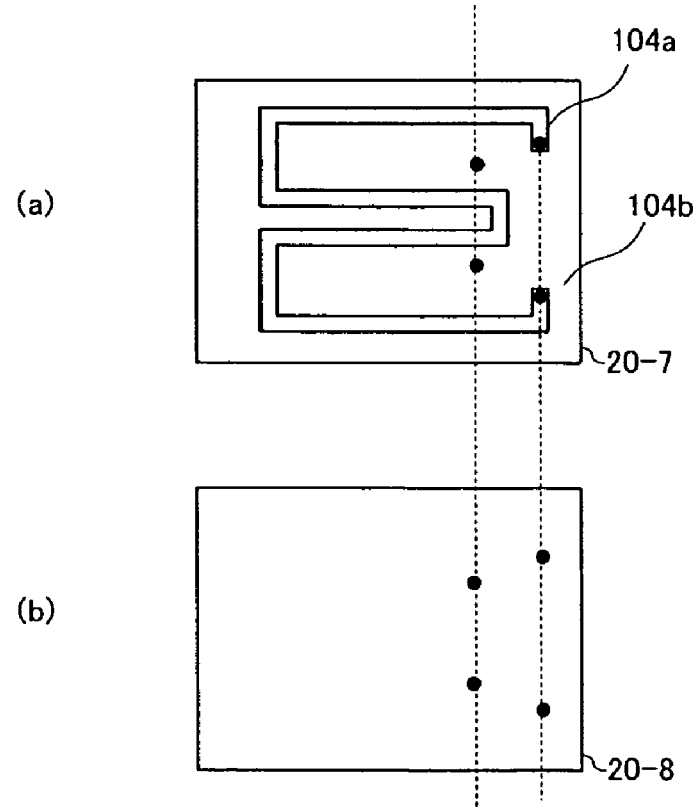
FIG. 36 is a fourth exploded plan view showing the arrangement of electrodes in layers of the balanced filter shown in FIG. 32.

FIG. 36 is a fourth exploded plan view showing the arrangement of electrodes in layers of the balanced filter shown in FIG. 32. As shown at (a) in FIG. 36, the stage constituting resonance electrode 108 is formed on a seventh dielectric layer 20-7 in junction with the wavelength shortening electrode 114 (described later) through a via, and the seventh dielectric layer 20-7 is arranged under the sixth dielectric layer 20-6 shown in FIG. 35(*b*).

Also, as shown at (b) in FIG. 36, vias for connecting the balanced-side resonance electrode 104 and the DC electrode 110 (described later) and vias for connecting the stage constituting resonance electrode 108 and the wavelength shortening electrode 114 (described later) are formed in an eighth dielectric layer 20-8. The eighth dielectric layer 20-8 is arranged under the seventh dielectric layer 20-7 shown in FIG. 36(*a*).

Figure 37:
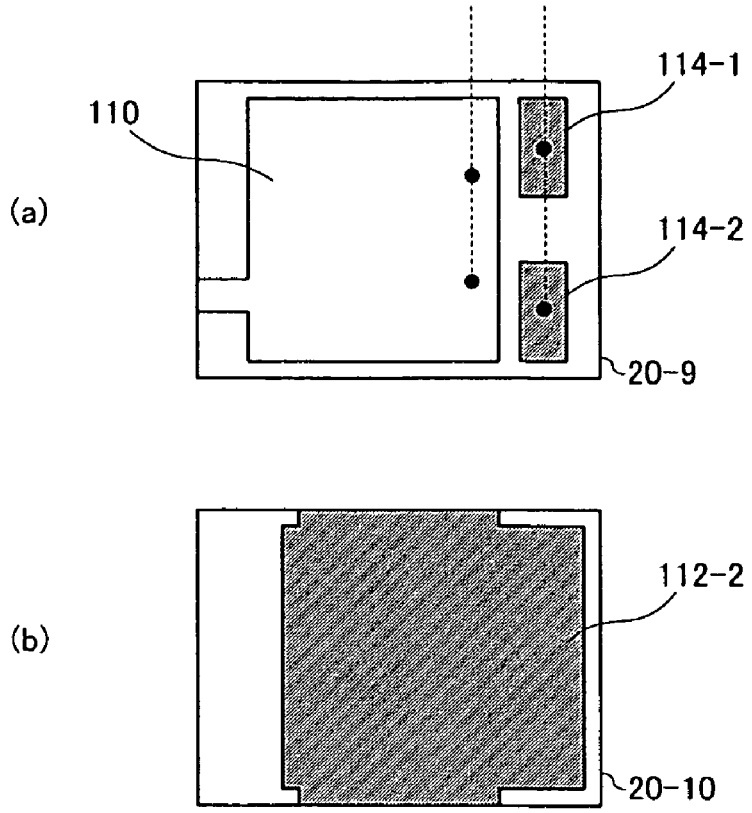
FIG. 37 is a fifth exploded plan view showing the arrangement of electrodes in layers of the balanced filter shown in FIG. 32.

FIG. 37 is a fifth exploded plan view showing the arrangement of electrodes in layers of the balanced filter shown in FIG. 32. As shown at (a) in FIG. 37, the DC electrode 110 connected to the balanced-side resonance electrode 104 and wavelength shortening electrodes 114-1 and 114-2 connected to the stage constituting resonance electrode 108 are formed in a ninth dielectric layer 20-9, and the ninth dielectric layer 20-9 is arranged under the eighth dielectric layer 20-8 shown in FIG. 36(*b*).

Also, as shown at (b) in FIG. 37, the GND electrode 112-2 connected to the GND terminals 516*a* and 516*b* is formed on a tenth dielectric layer 20-10, and the tenth dielectric layer 20-10 is arranged under the ninth dielectric layer 20-9 shown in FIG. 37(*a*).

Figure 38:
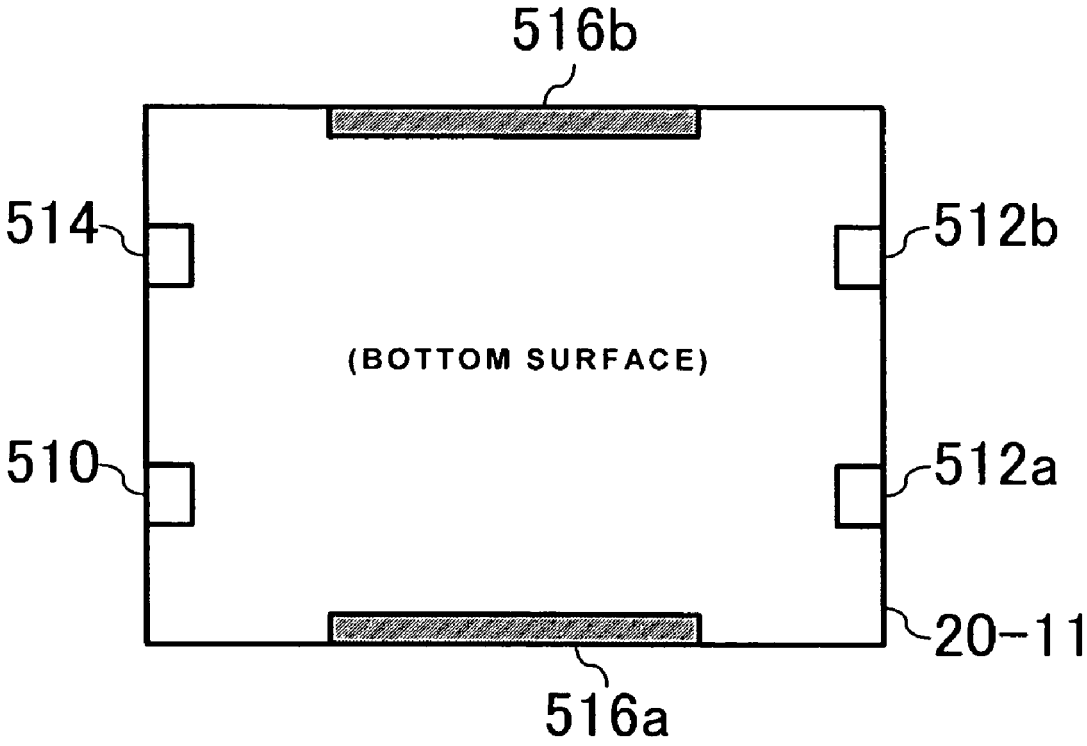
FIG. 38 is a sixth exploded plan view showing the arrangement of electrodes in a layer of the balanced filter shown in FIG. 32.

FIG. 38 is a sixth exploded plan view showing the arrangement of electrodes in a layer of the balanced filter shown in FIG. 32. As shown in FIG. 38, the DC terminal 514, the unbalanced terminal 510, the balanced terminals 512*a* and 512*b*, and the GND terminals 516*a* and 516*b* are formed on an eleventh dielectric layer 20-11, thereby constituting a bottom surface of the balanced filter. The eleventh dielectric layer 20-11 is arranged under the tenth dielectric layer 20-10 shown in FIG. 37(*b*).

The above-mentioned dielectric layers 20-1 to 20-11 are formed into an integral structure through stacking and baking steps, thus completing the balanced filter in the laminated form made up of the plurality of dielectric layers. The external electrode terminals denoted by 510-516 in the drawings are preferably formed by coating or plating after the stacking and baking steps. Other suitable intermediate layers may be interposed between the dielectric layers 20-1 to 20-11, as required.

Figure 39:
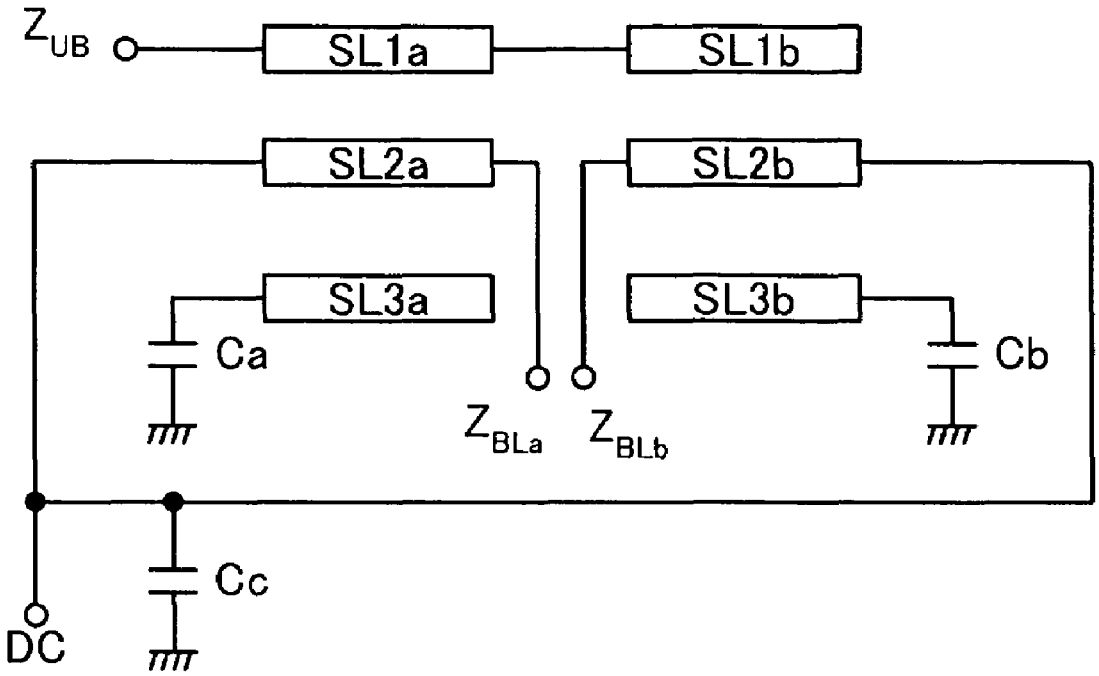
FIG. 39 is a circuit diagram showing an equivalent circuit of the balanced filter shown in FIG. 32.

FIG. 39 is a circuit diagram showing an equivalent circuit of the balanced filter shown in FIG. 32. In this balanced filter, as shown in FIG. 39, strip-line resonators SL1*a* and SL1*b* form the unbalanced-side resonance electrode 102, strip-line resonators SL2*a* and SL2*b* form the balanced-side resonance electrode 104, and strip-line resonators SL3*a*and SL3*b* form the stage constituting resonance electrode 108.

With the provision of the wavelength shortening electrode 114, capacitive coupling components Ca and Cb are formed respectively between the band control strip-lines SL3*a*, SL3*b* and the GND electrode 112-1. Also, with the provision of the DC electrode 110, a capacitive coupling component Cc is formed between the DC electrode 110 and the GND electrode 112-2, and this capacitive coupling component Cc functions as a capacitor for bypassing AC signals.

Figure 40:
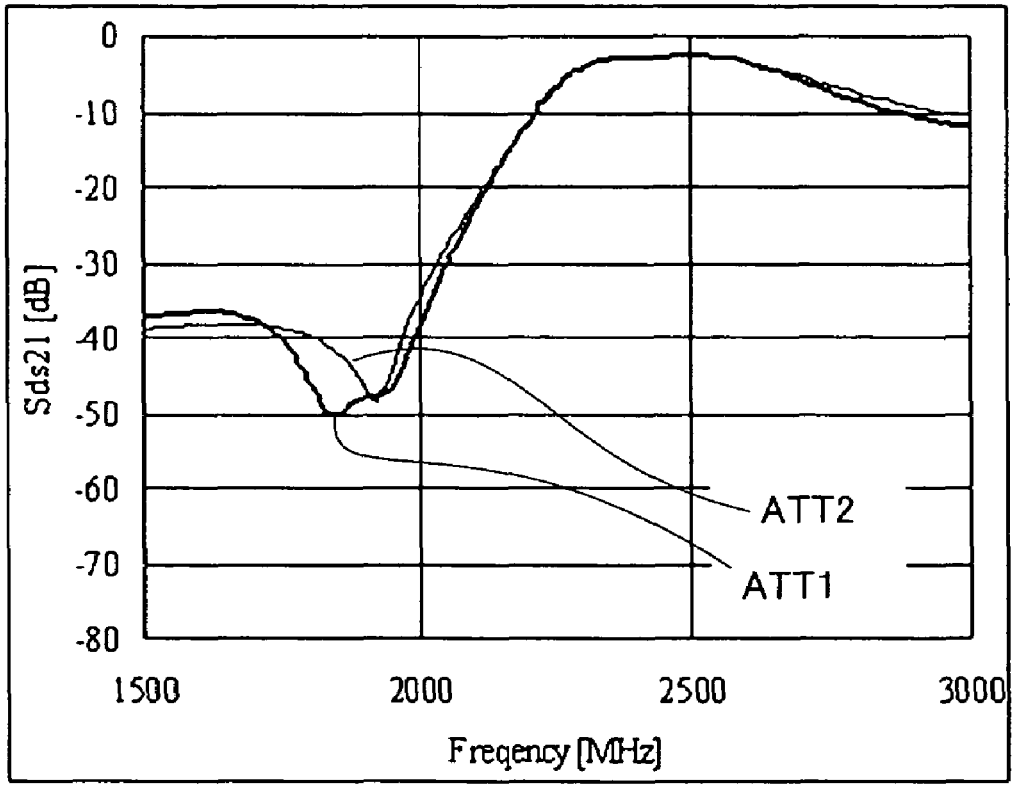
FIG. 40 is a characteristic graph showing an attenuation characteristic of the balanced filter shown in FIG. 32.

FIG. 40 is a characteristic graph showing an attenuation characteristic of the balanced filter shown in FIG. 32. As seen from FIG. 40, in spite of having a simpler structure, the balanced filter shown in FIG. 32 has an attenuation characteristic (ATT1) comparable to that (ATT2) of the known multistage balanced filter.

Figure 41:
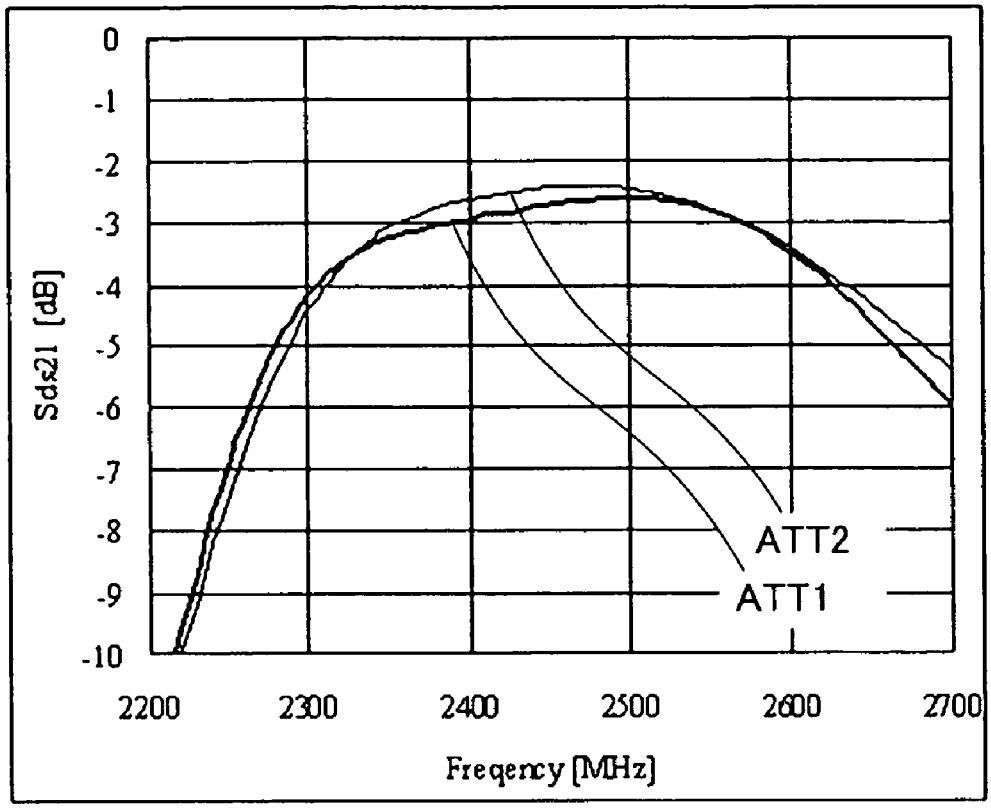
FIG. 41 is an enlarged characteristic graph showing the attenuation characteristic near the passband of the balanced filter shown in FIG. 32.

FIG. 41 is an enlarged characteristic graph showing an attenuation characteristic of the balanced filter, shown in FIG. 32, near the passage band thereof. As seen from FIG. 41, the attenuation characteristic (ATT2) of the known multistage balanced filter is reduced 1 dB or more, while the attenuation characteristic (ATT1) of the balanced filter shown in FIG. 32 is reduced about 0.3 dB. As a result, the balanced filter having a smaller loss than the known multistage balanced filter can be provided.

Figure 42:
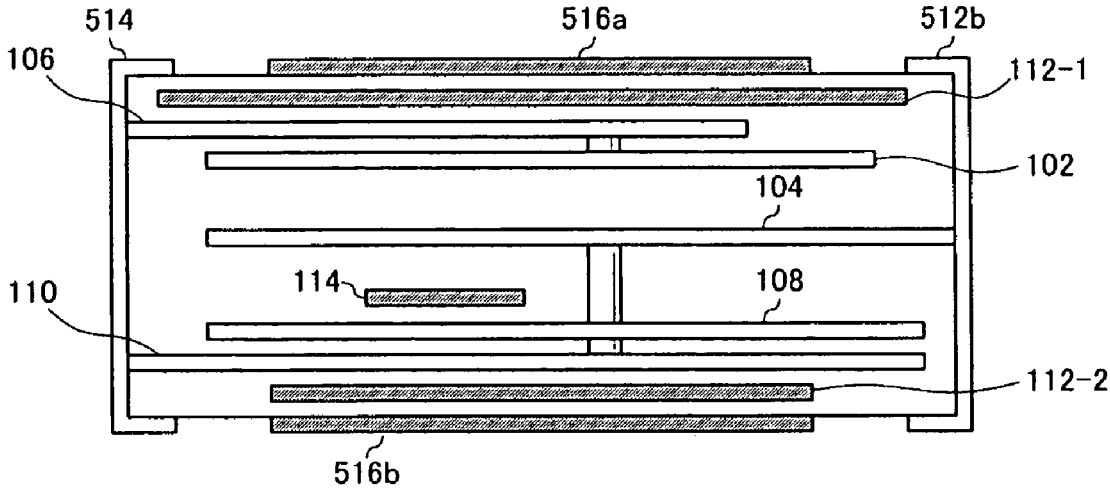
FIG. 42 is a sectional view showing a modification of the balanced filter shown in FIG. 32.

FIG. 42 is a sectional view showing a modification of the balanced filter shown in FIG. 32. In this modified balanced filter shown in FIG. 42, the position of the wavelength shortening electrode 114 and the shape of the stage constituting resonance electrode 108 are changed from those shown in FIG. 32. The other structure is the same as that of the balanced filter shown in FIG. 32. As shown in FIG. 42, the wavelength shortening electrode 114 in this embodiment is arranged between the balanced-side resonance electrode 104 and the stage constituting resonance electrode 108.

Figure 43:
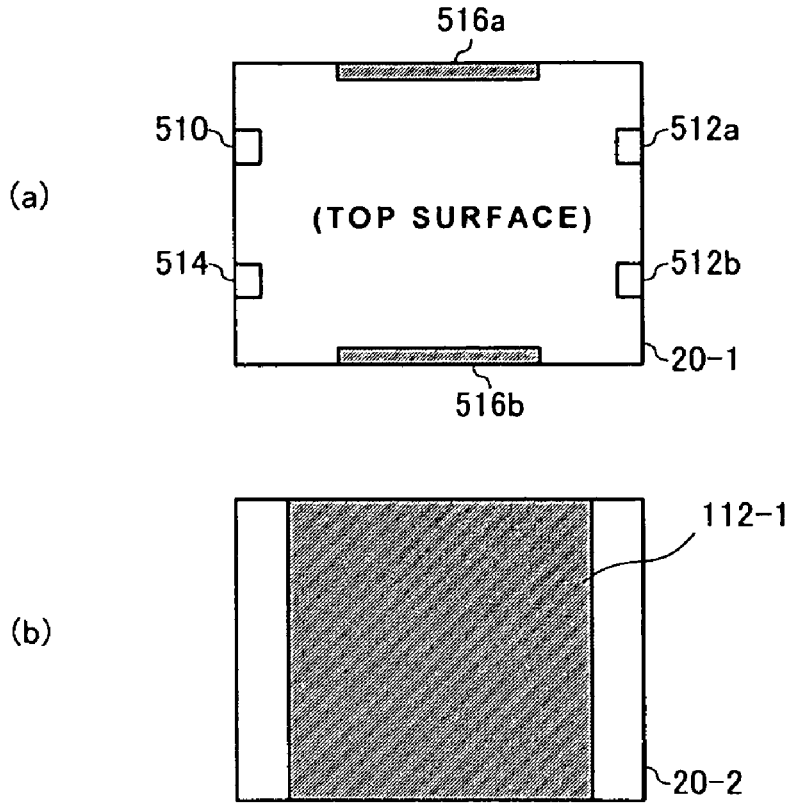
FIG. 43 is a first exploded plan view showing the arrangement of electrodes in layers of the balanced filter shown in FIG. 42.

FIG. 43 is a first exploded plan view showing the arrangement of electrodes in layers of the balanced filter shown in FIG. 42. As shown at (a) in FIG. 42, the unconnected terminal NC, the DC terminal 514, the unbalanced terminal 510, the balanced terminals 512*a* and 512*b*, and the GND terminals 516*a* and 516*b* are formed on a first dielectric layer 20-1, thereby constituting a top surface of the balanced filter.

Also, as shown at (b) in FIG. 43, the GND electrode 112-1 is formed on a second dielectric layer 20-2 in contact with the GND terminals 516*a* and 516*b*, and the second dielectric layer 20-2 is arranged under the first dielectric layer 20-1 shown in FIG. 43(*a*).

Figure 44:
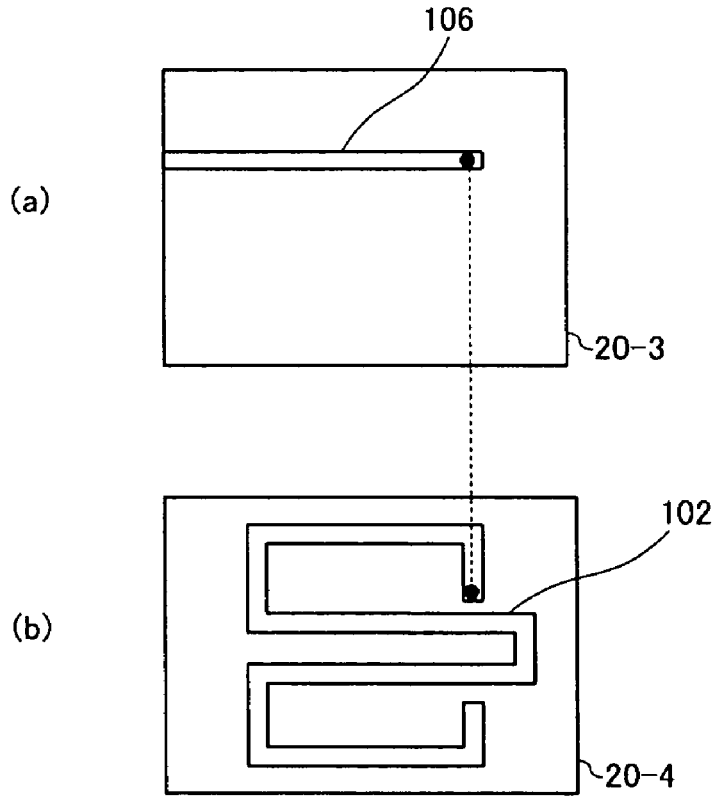
FIG. 44 is a second exploded plan view showing the arrangement of electrodes in layers of the balanced filter shown in FIG. 42.

FIG. 44 is a second exploded plan view showing the arrangement of electrodes in layers of the balanced filter shown in FIG. 42. As shown at (a) in FIG. 44, the input/output electrode 106 connected to the unbalanced terminal 512 is formed on a third dielectric layer 20-3, and the third dielectric layer 20-3 is arranged under the second dielectric layer 20-2 shown in FIG. 43(*b*).

Also, as shown at (b) in FIG. 44, the unbalanced-side resonance electrode 102 having a length of $\lambda/2$ is formed on a fourth dielectric layer 20-4 in junction with the input/output electrode 106, shown in FIG. 44(*a*), through a via, and the fourth dielectric layer 20-4 is arranged under the third dielectric layer 20-3 shown in FIG. 44(*a*).

Figure 45:
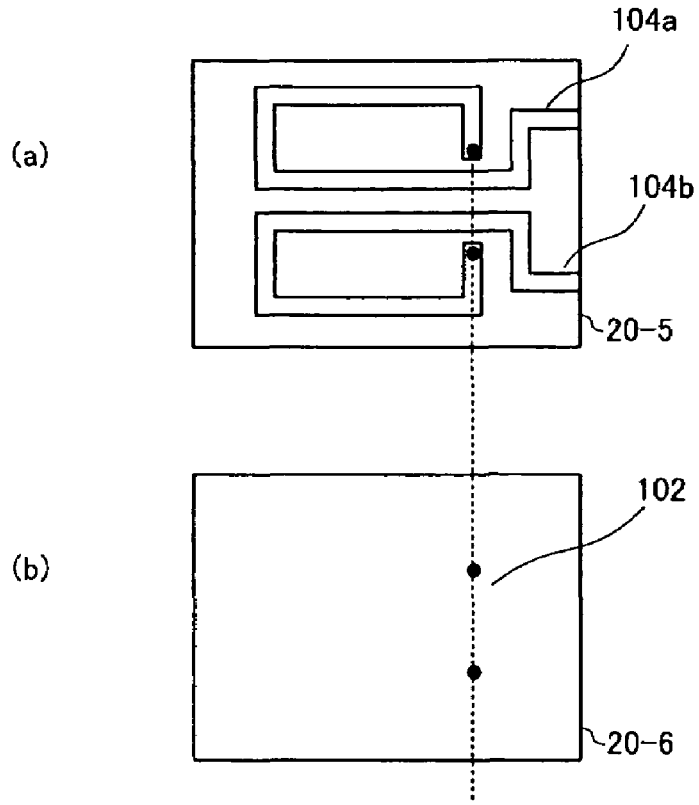
FIG. 45 is a third exploded plan view showing the arrangement of electrodes in layers of the balanced filter shown in FIG. 42.

FIG. 45 is a third exploded plan view showing the arrangement of electrodes in layers of the balanced filter shown in FIG. 42. As shown at (a) in FIG. 45, the balanced-side resonance electrode 104 made up of two strip-lines 104*a* and 104*b* is formed on a fifth dielectric layer 20-5, the strip-lines 104*a* and 104*b* being formed to extend in length of $\lambda/4$ from the balanced terminals 512*a* and 512*b*, respectively. The fifth dielectric layer 20-5 is arranged under the fourth dielectric layer 20-4 shown in FIG. 44(*b*).

Also, as shown at (b) in FIG. 45, vias for connecting the balanced-side resonance electrode 104 shown in FIG. 45(*a*) and the DC electrode 110 (described later) are formed in a sixth dielectric layer 20-6, and the sixth dielectric layer 20-6 is arranged under the fifth dielectric layer 20-5 shown in FIG. 45(*a*).

Figure 46:
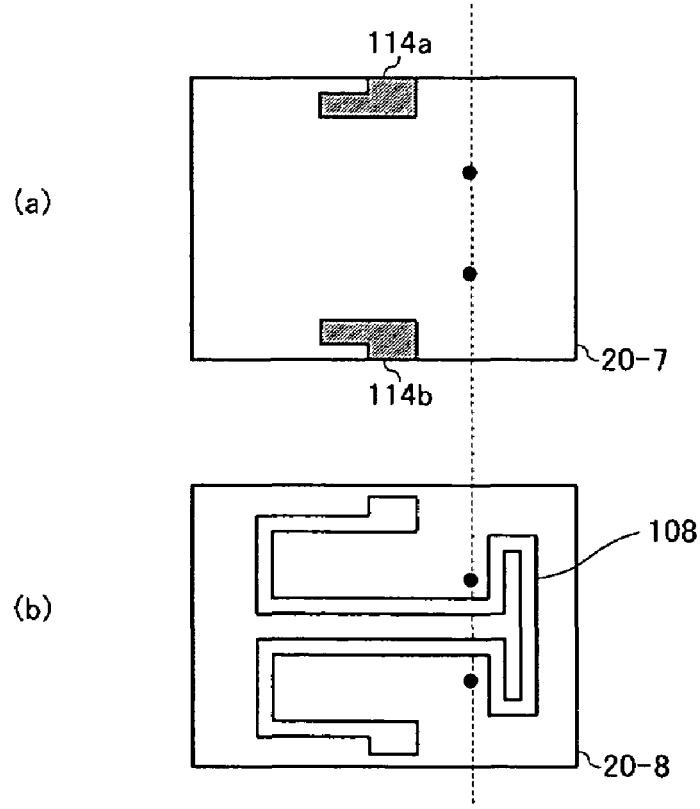
FIG. 46 is a fourth exploded plan view showing the arrangement of electrodes in layers of the balanced filter shown in FIG. 42.

FIG. 46 is a fourth exploded plan view showing the arrangement of electrodes in layers of the balanced filter shown in FIG. 42. As shown at (a) in FIG. 46, wavelength shortening electrodes 114*a* and 114*b* are formed in a seventh dielectric layer 20-7 in contact with the GND terminals 514*a* and 514*b*, respectively, and the seventh dielectric layer 20-7 is arranged under the sixth dielectric layer 20-6 shown in FIG. 45(*b*).

Also, as shown at (b) in FIG. 46, the stage constituting resonance electrode 108 is formed on an eighth dielectric layer 20-8 in opposed relation to the wavelength shortening electrode 114 (114*a*, 114*b*), and the eighth dielectric layer 20-8 is arranged under the seventh dielectric layer 20-7 shown in FIG. 46(*a*).

Figure 47:
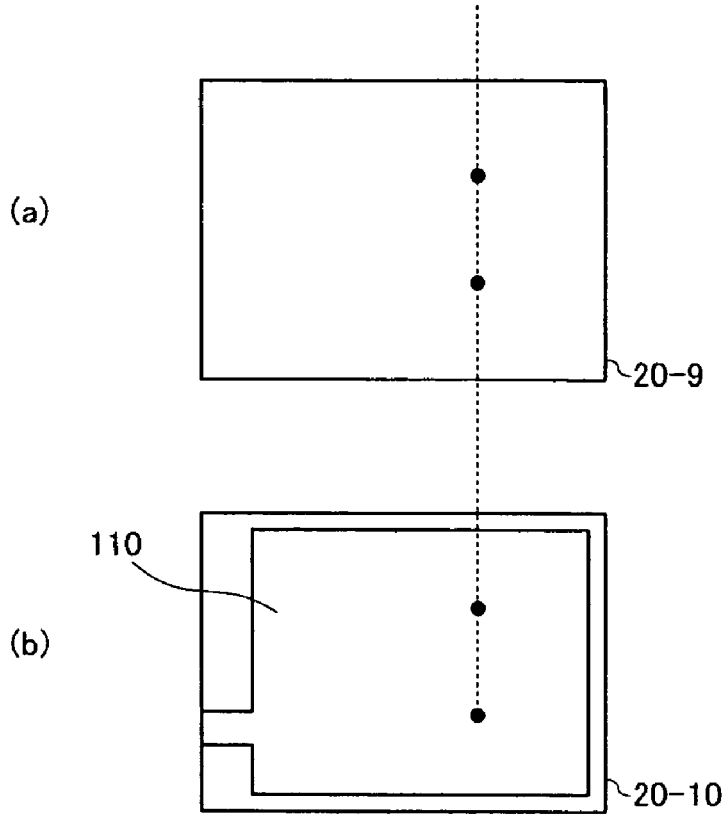
FIG. 47 is a fifth exploded plan view showing the arrangement of electrodes in layers of the balanced filter shown in FIG. 42.

FIG. 47 is a fifth exploded plan view showing the arrangement of electrodes in layers of the balanced filter shown in FIG. 42. As shown at (a) in FIG. 47, vias for connecting the balanced-side resonance electrode 104 and the DC electrode 110 (described later) are formed in a ninth dielectric layer 20-9, and the ninth dielectric layer 20-9 is arranged under the eighth dielectric layer 20-8 shown in FIG. 46(*b*).

Also, as shown at (b) in FIG. 47, the DC electrode 110 connected to the balanced-side resonance electrode 104 through the vias is formed on a tenth dielectric layer 20-10, and the tenth dielectric layer 20-10 is arranged under the ninth dielectric layer 20-9 shown in FIG. 47(*a*).

Figure 48:
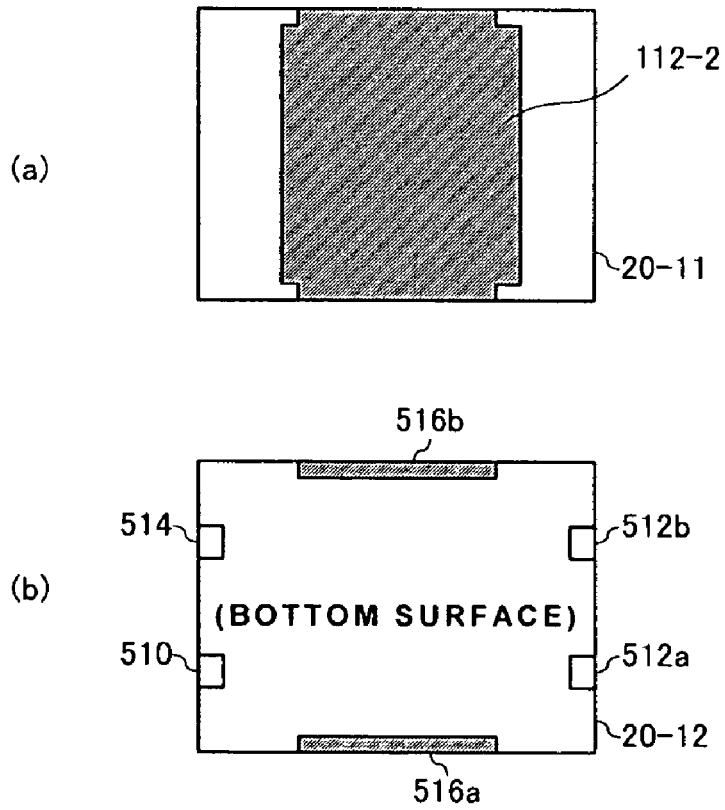
FIG. 48 is a sixth exploded plan view showing the construction of electrodes in layers of the balanced filter shown in FIG. 42.

FIG. 48 is a sixth exploded plan view showing the arrangement of electrodes in layers of the balanced filter shown in FIG. 42. As shown at (a) in FIG. 48, the GND electrode 112-2 connected to the GND terminals 516*a* and 516*b* is formed on an eleventh dielectric layer 20-11, and the eleventh dielectric layer 20-11 is arranged under the tenth dielectric layer 20-10 shown in FIG. 47(*b*).

Also, as shown at (b) in FIG. 48, the DC terminal 514, the unbalanced terminal 510, the balanced terminals 512*a* and 512*b*, and the GND terminals 516*a* and 516*b* are formed on a twelfth dielectric layer 20-12, thereby constituting a bottom surface of the balanced filter. The twelfth dielectric layer 20-12 is arranged under the eleventh dielectric layer 20-11 shown in FIG. 48(*a*).

The above-mentioned dielectric layers 20-1 to 20-12 are formed into an integral structure through stacking and baking steps, thus completing the balanced filter in the laminated form made up of the plurality of dielectric layers. The external electrode terminals denoted by 510-516 in the drawings are preferably formed by coating or plating after the stacking and baking steps. Other suitable intermediate layers may be interposed between the dielectric layers 20-1 to 20-12, as required.

Figure 49:
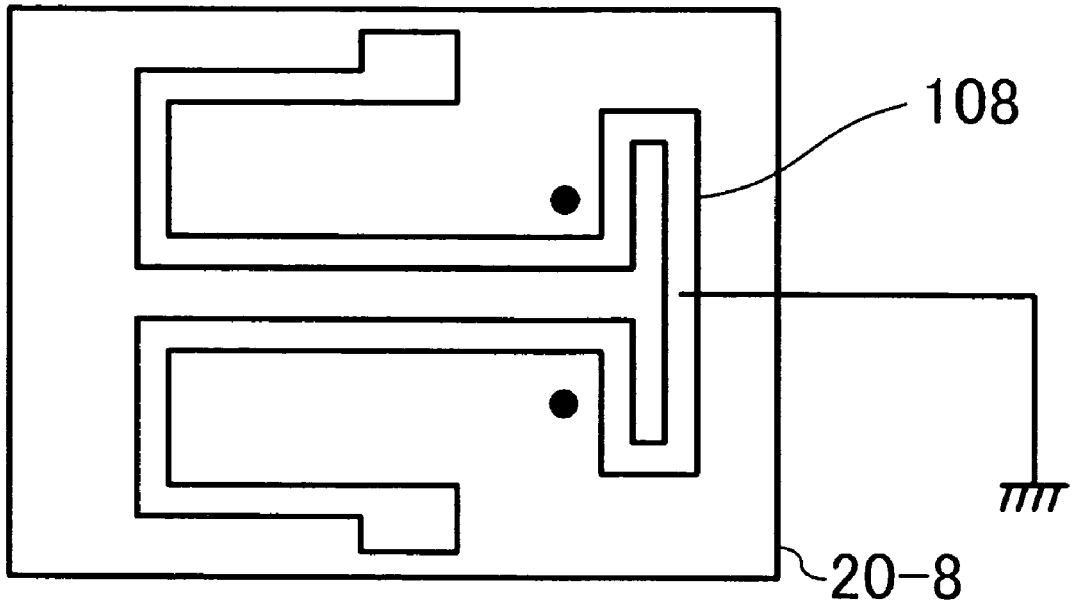
FIG. 49 is an exploded plan view showing a modification of a stage constituting resonance electrode formed on an eighth dielectric layer shown in FIG. 46.

FIG. 49 is an exploded plan view showing a modification of the stage constituting resonance electrode formed on the eighth dielectric layer shown in FIG. 46. While the stage constituting resonance electrode 108 shown in FIG. 46 is constituted in an open state, the stage constituting resonance electrode 108 may be connected at its middle point to GND as shown in FIG. 49.

Figure 50:
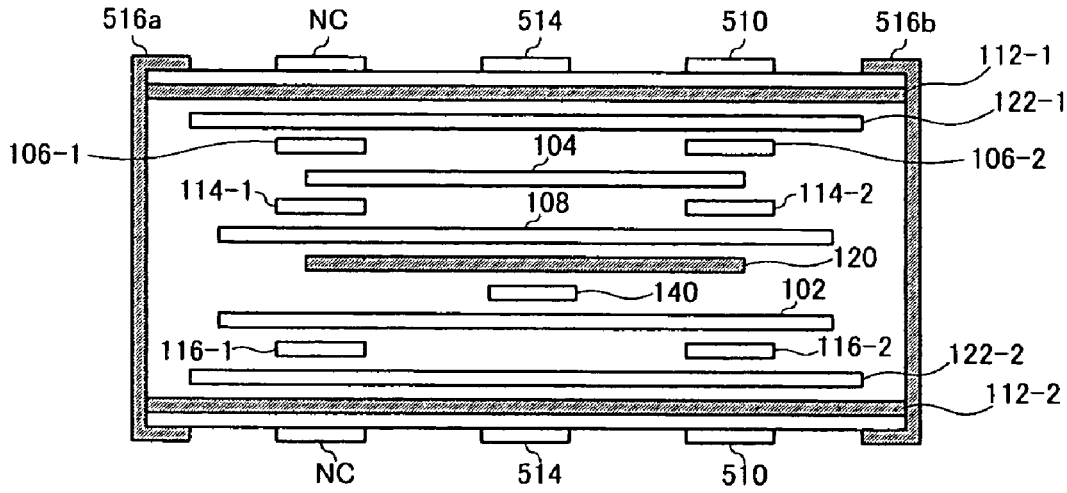
FIG. 50 is a sectional view showing a modification of the balanced filter shown in FIG. 8.

FIG. 50 is a sectional view showing a modification of the balanced filter shown in FIG. 8. The balanced filter shown in FIG. 50 has a strip-line structure in which an unbalanced-side resonance electrode 102, a balanced-side resonance electrode 104, and a stage constituting resonance electrode 108 are formed on respective dielectric layers in laminated arrangement between GND electrodes 112-1 and 112-2 which are connected respectively to the GND terminals 516*a*, 516*b*.

In that structure, the unbalanced-side resonance electrode 102 and the balanced-side resonance electrode 104 are formed in adjacently opposed relation with the dielectric layer interposed between them, and the stage constituting resonance electrode 108 is arranged between those electrodes 102 and 104, thereby constituting a balanced filter in which strip-line resonance electrodes are laminated in the opposed multistage form.

Also, a trap control coupling electrode 140 is arranged between the stage constituting resonance electrode 108 and the unbalanced-side resonance electrode 102, and the coupling action of the trap control coupling electrode 140 controls the position of a trap that is formed at the lower-frequency side in the passage band.

Further, an intermediate electrode 122-1 and coupling electrodes 106-1, 106-2 are arranged between the GND electrode 112 and the balanced-side resonance electrode 104, and a second coupling electrode 114 is arranged between the balanced-side resonance electrode 104 and the stage constituting resonance electrode 108. A wavelength shortening electrode 120 is arranged between the stage constituting resonance electrode 108 and the trap control coupling electrode 140. Third coupling electrodes 116-1 and 116-2 and an intermediate electrode 122-2 are arranged between the unbalanced-side resonance electrode 102 and the GND electrode 112-2.

A DC electrode 110 connected to a DC terminal 514 is arranged and functions as a DC supply layer with capacitive coupling caused between the stage constituting resonance electrode 108 and the GND electrode 112-2.

Figure 51:
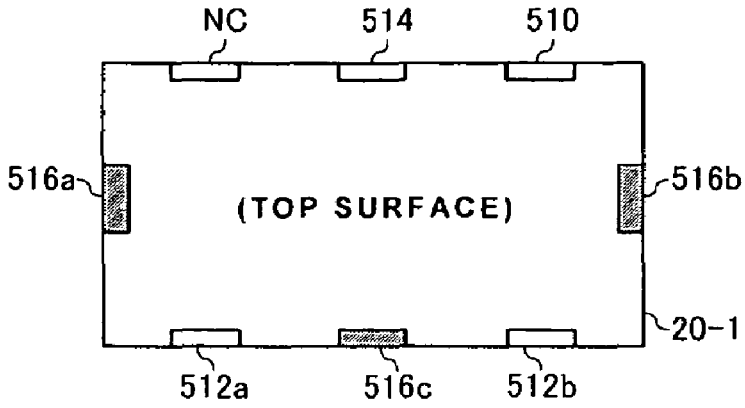
FIG. 51 is a first exploded plan view showing the arrangement of electrodes in layers of the balanced filter shown in FIG. 50.
Figure 51:
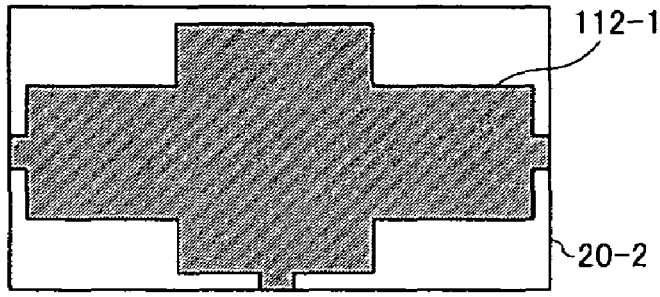

Additionally, the unbalanced-side resonance electrode 102 is connected to an unbalanced terminal 510, and the balanced-side resonance electrode 104 is connected to unbalanced terminals 512*a*, 512*b* shown in FIG. 51. The GND electrodes 112-1 and 112-2 are connected to GND terminals 516*a*, 516*b* and 516*c*, and the DC electrode 110 is connected to the DC terminal 514.

FIG. 51 is a first exploded plan view showing the arrangement of electrodes in layers of the balanced filter shown in FIG. 50. As shown at (a) in FIG. 51, an unconnected terminal NC, the DC terminal 514, the unbalanced terminal 510, the balanced terminals 512*a* and 512*b*, and the GND terminals 516*a*-516*c* are formed on a first dielectric layer 20-1, thereby constituting a top surface of the modified balanced filter.

Also, as shown at (b) in FIG. 51, the GND electrode 112-1 is formed on a second dielectric layer 20-2 in contact with the GND terminals 516*a*-516*c*, and the second dielectric layer 20-2 is arranged under the first dielectric layer 20-1 shown in FIG. 51(*a*).

Figure 52:
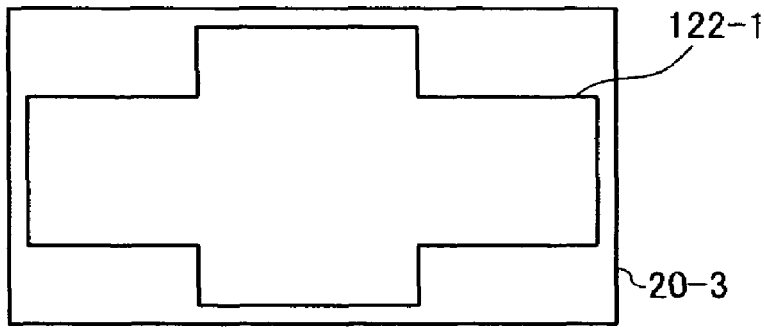
FIG. 52 is a second exploded plan view showing the arrangement of electrodes in layers of the balanced filter shown in FIG. 50.
Figure 52:
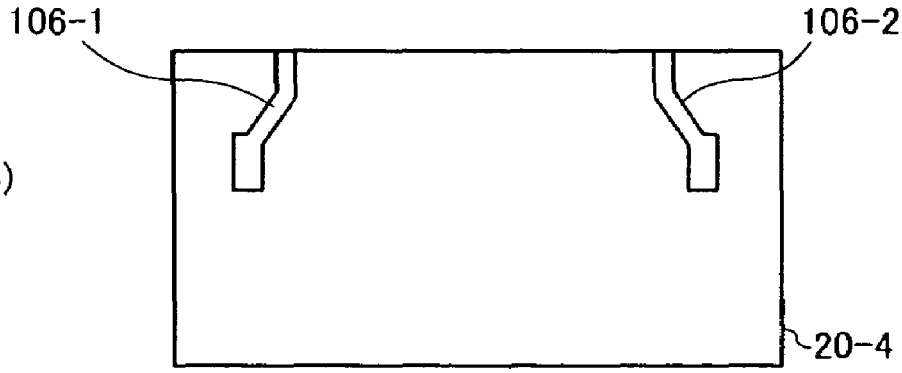

FIG. 52 is a second exploded plan view showing the arrangement of electrodes in layers of the balanced filter shown in FIG. 50. As shown at (a) in FIG. 52, the intermediate electrode 122-1 is formed on a third dielectric layer 20-3 in position and shape opposed to the GND electrode 112-1 shown in FIG. 51(*b*).

Also, as shown at (b) in FIG. 52, coupling electrodes 106-1 and 106-2 connected respectively to the balanced terminals 512*a* and 512*b* are formed on a fourth dielectric layer 20-4, and the fourth dielectric layer 20-4 is arranged under the third dielectric layer 20-3 shown in FIG. 51(*a*).

Figure 53:
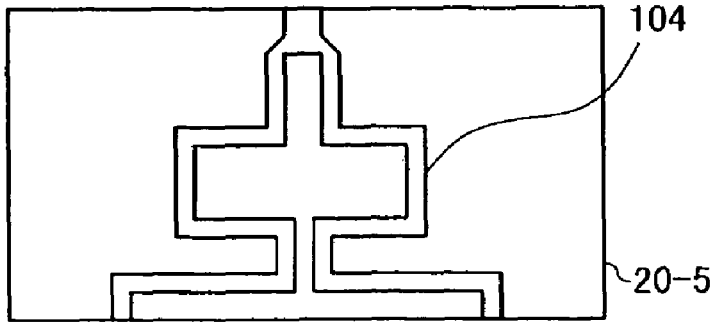
FIG. 53 is a third exploded plan view showing the arrangement of electrodes in layers of the balanced filter shown in FIG. 50.
Figure 53:
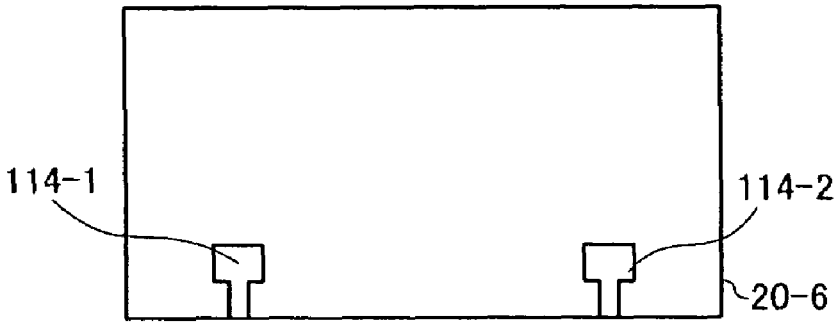

FIG. 53 is a third exploded plan view showing the arrangement of electrodes in layers of the balanced filter shown in FIG. 50. As shown at (a) in FIG. 53, the balanced-side resonance electrode 104 made up of two strip-lines is formed on a fifth dielectric layer 20-5, each of the strip-lines being formed to extend in length of $\lambda/4$ from the DC terminal 514.

The fifth dielectric layer 20-5 is arranged under the fourth dielectric layer 20-4 shown in FIG. 52(*b*).

Also, as shown at (b) in FIG. 53, second coupling electrodes 114-1 and 114-2 connected respectively to the balanced terminals 512*a* and 512*b* are formed on a sixth dielectric layer 20-6, and the sixth dielectric layer 20-6 is arranged under the fifth dielectric layer 20-5 shown in FIG. 53(*a*).

Figure 54:
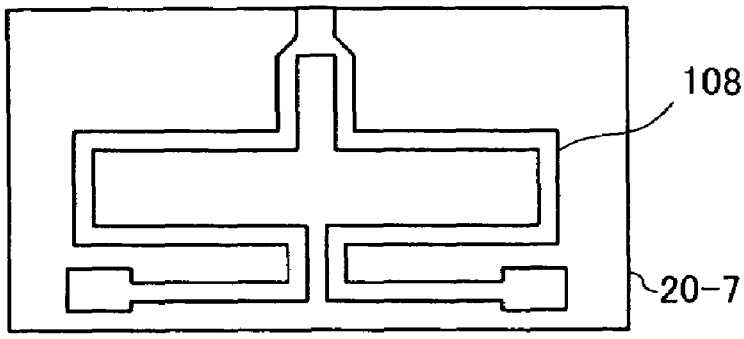
FIG. 54 is a fourth exploded plan view showing the arrangement of electrodes in layers of the balanced filter shown in FIG. 50.
Figure 54:
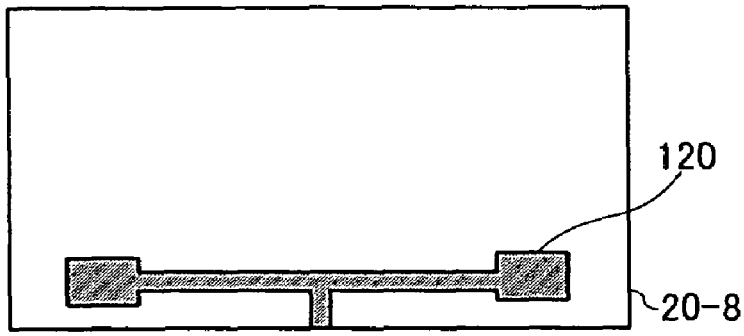

FIG. 54 is a fourth exploded plan view showing the arrangement of electrodes in layers of the balanced filter shown in FIG. 50. As shown at (a) in FIG. 54, the stage constituting resonance electrode 108 made up of two strip-lines is formed on a seventh dielectric layer 20-7 in a state not connected to the balanced terminals 512*a* and 512*b*, each of the strip-lines being formed to extend in length of $\lambda/4\pm\alpha$ from the DC terminal 514. The seventh dielectric layer 20-7 is arranged under the sixth dielectric layer 20-6 shown in FIG. 53(*b*).

Also, as shown at (b) in FIG. 54, the wavelength shortening electrode 120 connected to the GND terminal 516*c* is formed on an eighth dielectric layer 20-8, shown in FIG. 54(*a*), in position and shape opposed to the open-end side of the stage constituting resonance electrode 108. The eighth dielectric layer 20-8 is arranged under the seventh dielectric layer 20-7 shown in FIG. 54(*a*).

Figure 55:
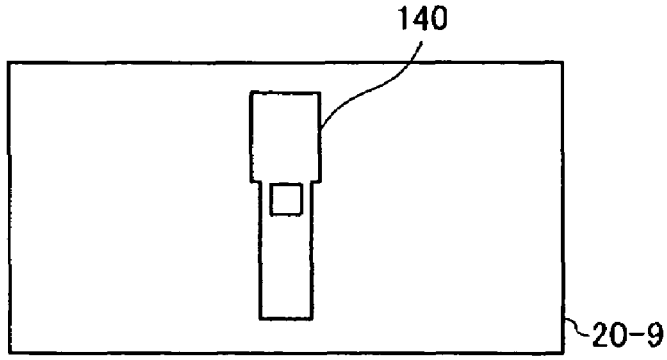
FIG. 55 is a fifth exploded plan view showing the arrangement of electrodes in layers of the balanced filter shown in FIG. 50.
Figure 55:
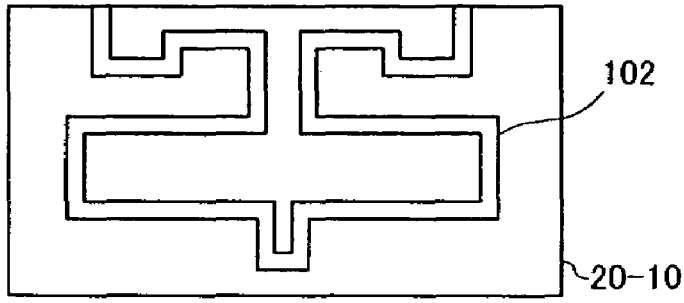

FIG. 55 is a fifth exploded plan view showing the arrangement of electrodes in layers of the balanced filter shown in FIG. 50. As shown at (a) in FIG. 55, the trap control coupling electrode 140 is formed on a ninth dielectric layer 20-9 in position and shape establishing coupling the two strip-lines of the stage constituting resonance electrode 108, shown in FIG. 54(*a*), at both positions of the shorted end side and the open end side thereof. The ninth dielectric layer 20-9 is arranged under the eighth dielectric layer 20-8 shown in FIG. 54(*b*).

Also, as shown at (b) in FIG. 55, the unbalanced-side resonance electrode 102 having a length of $\lambda/2$ is formed on a tenth dielectric layer 20-10 in junction with the NC terminal and the unbalanced terminal 510, and the tenth dielectric layer 20-10 is arranged under the ninth dielectric layer 20-9 shown in FIG. 55(*a*).

Figure 56:
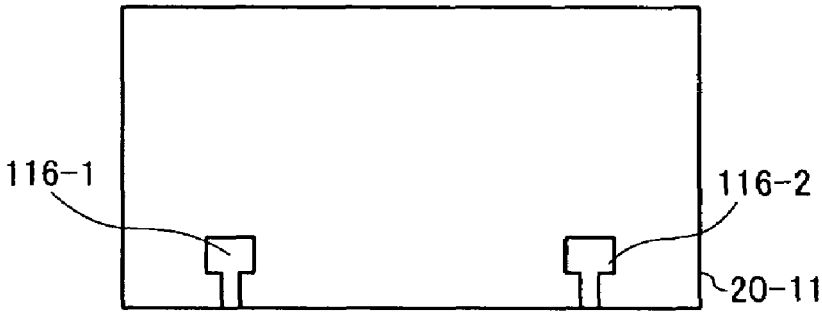
FIG. 56 is a sixth exploded plan view showing the construction of electrodes in layers of the balanced filter shown in FIG. 50.
Figure 56:
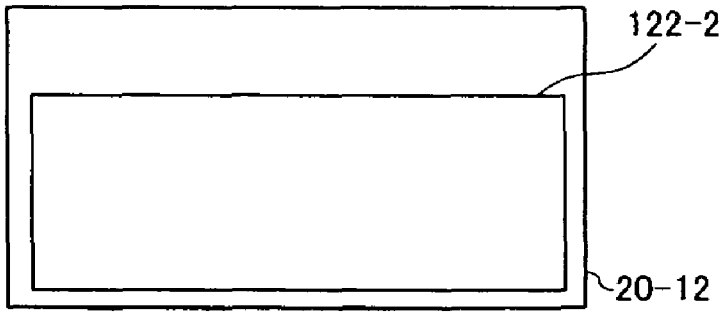

FIG. 56 is a sixth exploded plan view showing the arrangement of electrodes in layers of the balanced filter shown in FIG. 50. As shown at (a) in FIG. 56, third coupling electrodes 116-1 and 116-2 connected to the balanced terminals 512*a* and 512*b*, respectively, are formed on an eleventh dielectric layer 20-11, and the eleventh dielectric layer 20-11 is arranged under the tenth dielectric layer 20-10 shown in FIG. 55(*b*).

Figure 57:
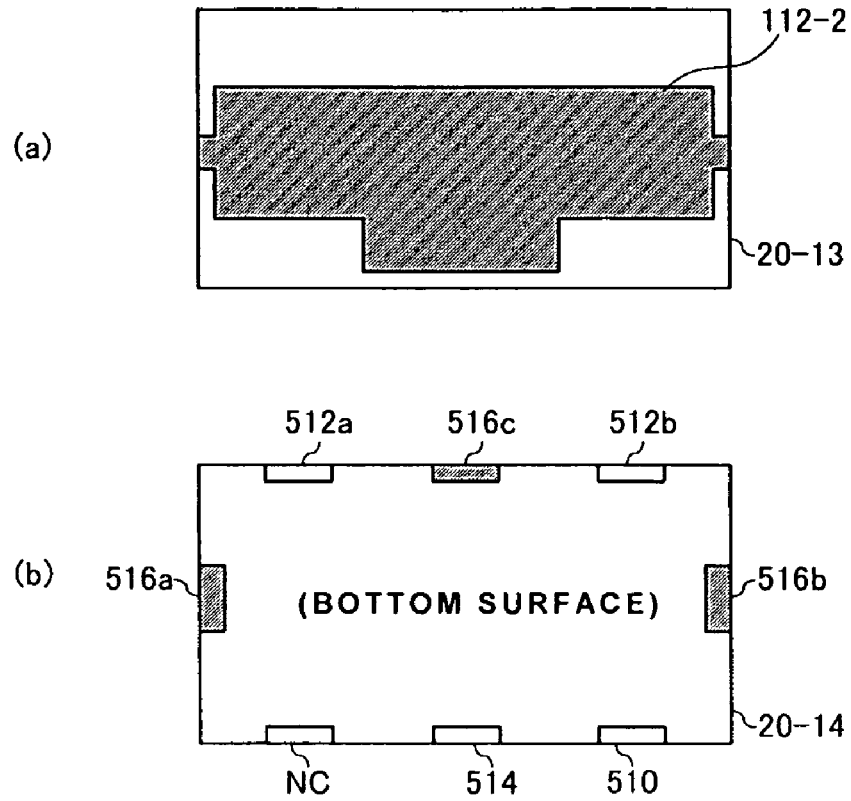
FIG. 57 is a seventh exploded plan view showing the construction of electrodes in layers of the balanced filter shown in FIG. 50.

Also, as shown at (b) in FIG. 56, the intermediate electrode 122-2 is formed on a twelfth dielectric layer 20-12 in position and shape opposed to the GND electrode 112-2 shown in FIG. 57(*a*). FIG. 57 is a seventh exploded plan view showing the arrangement of electrodes in layers of the balanced filter shown in FIG. 50. As shown at (a) in FIG. 57, The GND electrode 112-2 connected to the GND terminals 516*a*-516*c* is formed on a thirteenth dielectric layer 20-13, and the thirteenth dielectric layer 20-13 is arranged under the twelfth dielectric layer 20-12 shown in FIG. 56(*b*).

Also, as shown at (b) in FIG. 57, the balanced terminals 512*a* and 512*b*, the GND terminals 516*a*-516*c*, the unconnected terminal NC, the DC terminal 514, and the unbalanced terminal 510 are formed on a fourteenth dielectric layer 20-14, thereby constituting a bottom surface of the modified balanced filter. The fourteenth dielectric layer 20-14 is arranged under the thirteenth dielectric layer 20-13 shown in FIG. 57(*a*).

The dielectric layers 20-1 to 20-14 are formed into an integral structure through stacking and baking steps, thus completing the balanced filter in the laminated form made up of the plurality of dielectric layers. The external electrode terminals denoted by 510-516 in the drawings are preferably formed by coating or plating after the stacking and baking steps. Other suitable intermediate layers may be interposed between the dielectric layers 20-1 to 20-14, as required.

Figure 58:
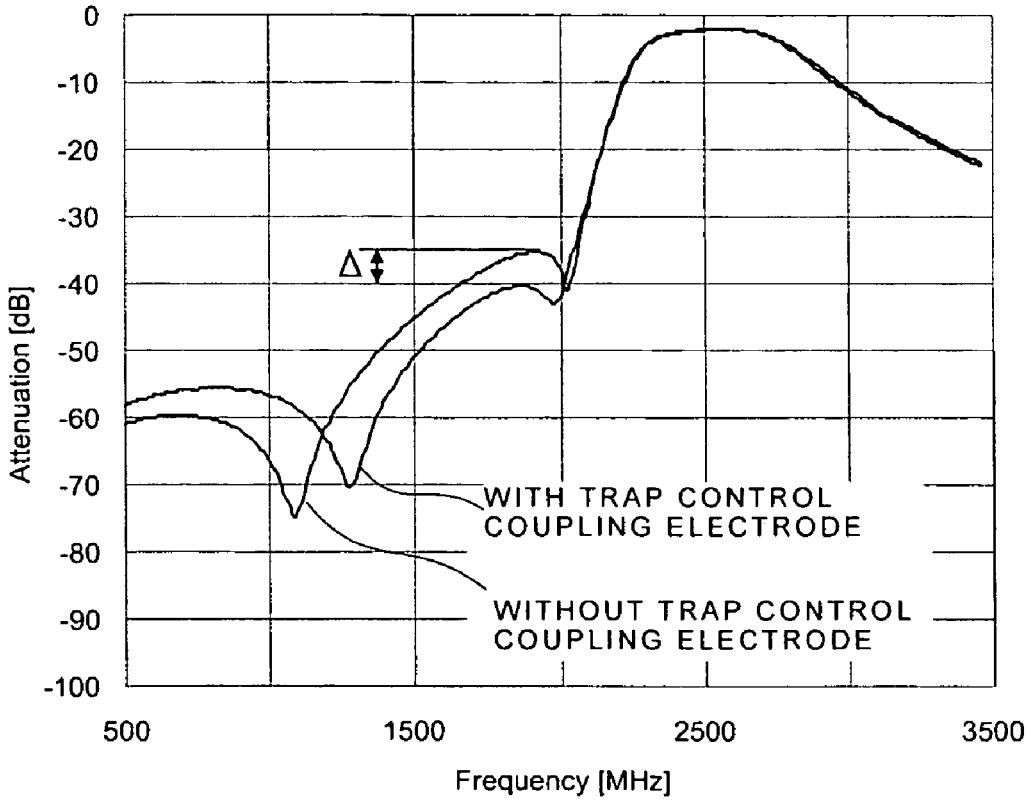
FIG. 58 is a characteristic graph showing an effect resulting with the provision of a trap control coupling electrode 140 shown in FIG. 50 is disposed.

FIG. 58 is a characteristic graph showing an effect resulting from providing the trap control coupling electrode 140 shown in FIG. 50. As shown in FIG. 58, with the provision of the trap control coupling electrode 140 between the unbalanced-side resonance electrode 102 and the stage constituting resonance electrode 108, a trap formed at the lower-frequency side in the band of 1 GHz-1.5 GHz can be shifted closer to the passage band. As a result, an attenuation rate near 1.9 GHz, which is utilized as another communication band, can be increased $\Delta$, as shown, in comparison with the case not providing the trap control coupling electrode 140.

Figure 59:
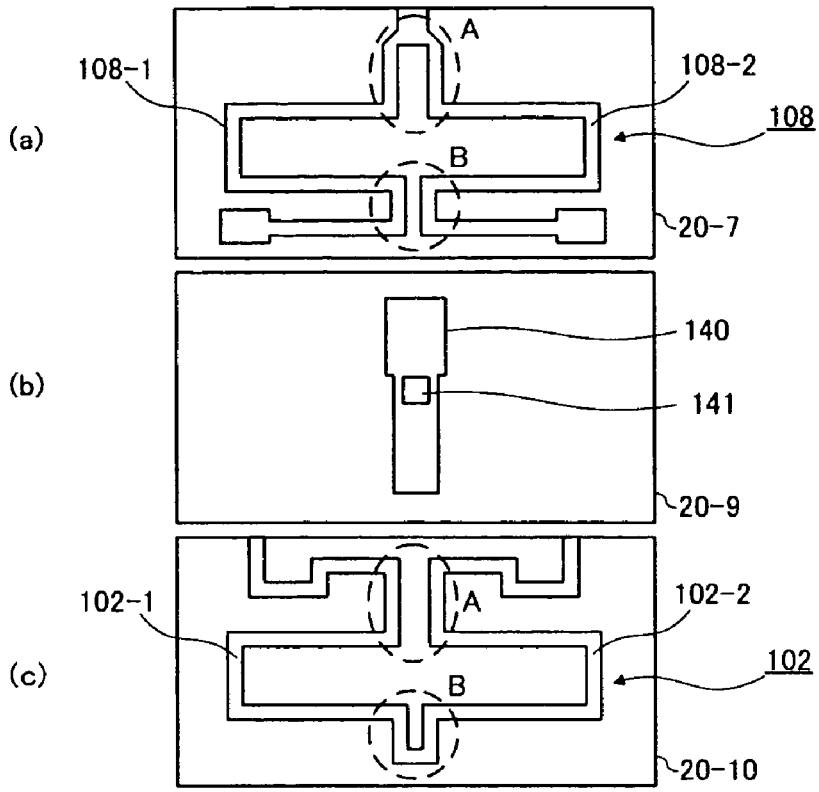
FIG. 59 is an exploded plan view showing the opposing relationship among the trap control coupling electrode 140, a stage constituting resonance electrode 108, and an unbalanced-side resonance electrode 102 shown in FIG. 50.

FIG. 59 is an exploded plan view showing the opposing relationship among the trap control coupling electrode 140, the stage constituting resonance electrode 108, and the unbalanced-side resonance electrode 102 shown in FIG. 50. As seen from FIG. 59, the trap control coupling electrode 140 shown at (b) in FIG. 50 is arranged between the stage constituting resonance electrode 108 shown at (a) in FIG. 50 and the unbalanced-side resonance electrode 102 shown at (c) in FIG. 50 to establish coupling in and/or between portions of the respective strip-lines, indicated by dotted lines A, B, which constitute the stage constituting resonance electrode 108 and the unbalanced-side resonance electrode 102, thereby providing the trap control effect described above with reference to FIG. 58.

As shown in FIG. 59(*a*), the stage constituting resonance electrode 108 is made up of two strip-lines 108-1 and 108-2 each formed to extend in length of $\lambda/4\pm\alpha$ from the DC terminal 514. Assuming that one side of each strip-line connected to the DC terminal 514 is a shorted end and the opposite side thereof is an open end, the portion indicated by the dotted line A in FIG. 59(*a*) serves to establish coupling of both the strip-lines 108-1 and 108-2 at the shorted end side, and the portion indicated by the dotted line B serves to establish coupling of both the strip-lines 108-1 and 108-2 at the open end side.

Thus, a satisfactory trap control effect can be obtained by coupling the two strip-lines, which constitute the stage constituting resonance electrode 108, at both shorted end side and the open end side. Incidentally, as shown in FIG. 59(*a*), the strip-lines 108-1 and 108-2 of the stage constituting resonance electrode 108 are formed in such a pattern shape that they come close to each other in the portions indicated by the dotted lines A and B.

Also, as shown in FIG. 59(*c*), the unbalanced-side resonance electrode 102 is formed in a state where one strip-line having a length of $\lambda/2$ is formed at its both ends to the NC terminal and the unbalanced terminal 510. Looking at the one $\lambda/2$ strip-line with a middle point (i.e., a $\lambda/4$ point from each end) being a base point, it can be said that the one $\lambda/2$ strip-line is made up of two strip-lines 102-1 and 102-2.

Accordingly, the trap control coupling electrode 140 shown in FIG. 59(*b*) establishes coupling in and/or between the portion indicated by the dotted line B, which corresponds to the middle position of the $\lambda/2$ strip-line shown in FIG. 59(*c*), and the portion indicated by the dotted line A, which corresponds to respective parts of the strip-lines 102-1 and 102-2 positioned opposite to the middle position of the $\lambda/2$ strip-line. By thus coupling the two strip-lines constituting the unbalanced-side resonance electrode 102 at the middle position of $\lambda/2$ and a position opposed thereto, a satisfactory trap control effect can be obtained. Incidentally, as shown in FIG. 59(*c*), the strip-lines 102-1 and 102-2 constituting the unbalanced-side resonance electrode 102 are formed in such a pattern shape that they come close to each other in the portions indicated by the dotted lines A and B.

In addition, as shown in FIG. 59(*b*), an opening 141 is formed in the trap control coupling electrode 140 in a connecting area between the dotted-line portions A and B shown in FIGS. 59(*a*) and 59(*c*). The opening 141 has the functions of not only shunting a current path, but also adjusting the trap position.

Figure 60:
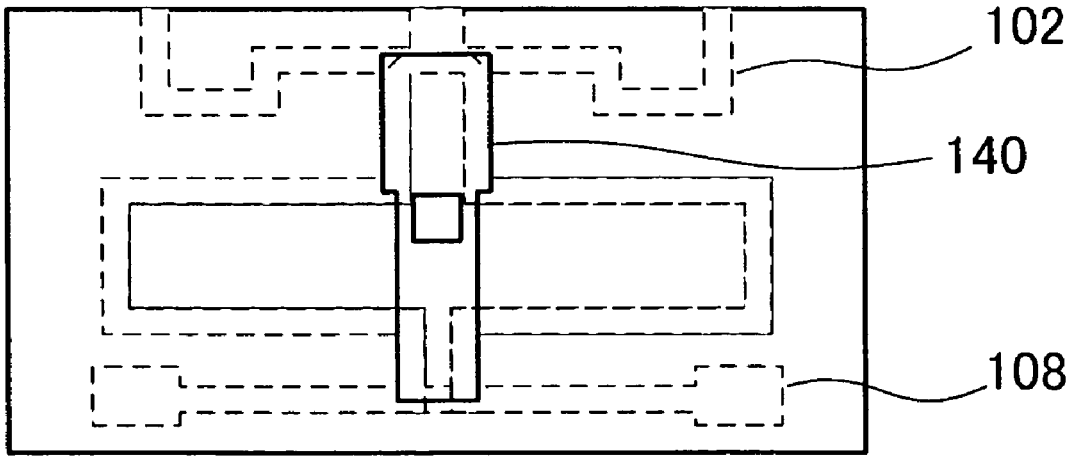
FIG. 60 is a seeing-through plan view showing the opposing relationship among the trap control coupling electrode 140, the stage constituting resonance electrode 108, and the unbalanced-side resonance electrode 102 shown in FIG. 50.

FIG. 60 is a seeing-through plan view showing the opposing relationship among the trap control coupling electrode 140, the stage constituting resonance electrode 108, and the unbalanced-side resonance electrode 102 shown in FIG. 50. As shown in FIG. 60, the trap control coupling electrode 140 is disposed in a position capable of establishing the coupling in and/or between the dotted-line portions A and B of the unbalanced-side resonance electrode 102 and the stage constituting resonance electrode 108 shown in FIG. 59.

Figure 61:
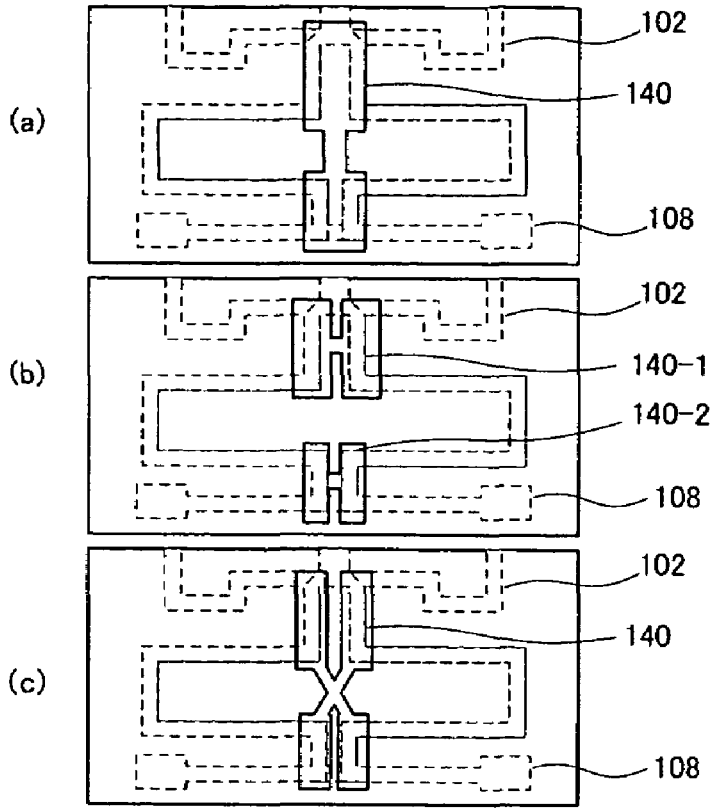
FIG. 61 is a seeing-through plan view showing another example of the trap control coupling electrode shown in FIG. 60.

FIG. 61 is a seeing-through plan view showing another example of the trap control coupling electrode shown in FIG. 60. As shown at (a) in FIG. 61, the trap control coupling electrode may be formed to couple the dotted-line portions A and B shown in FIG. 59 through a single narrow pattern. Alternatively, as shown at (b) in FIG. 61, the trap control coupling electrode may be formed such that the coupling is independently established through a single narrow pattern in each of the dotted-line portions A and B. Further, as shown at (c) in FIG. 61, the trap control coupling electrode may be formed such that the left strip-line located in the dotted-line portion A shown in FIG. 59 is coupled to the right strip-line located in the dotted-line portion B through a first oblique narrow pattern, and the right strip-line located in the dotted-line portion A is coupled to the left strip-line located in the dotted-line portion B through a second oblique narrow pattern.

Figure 62:
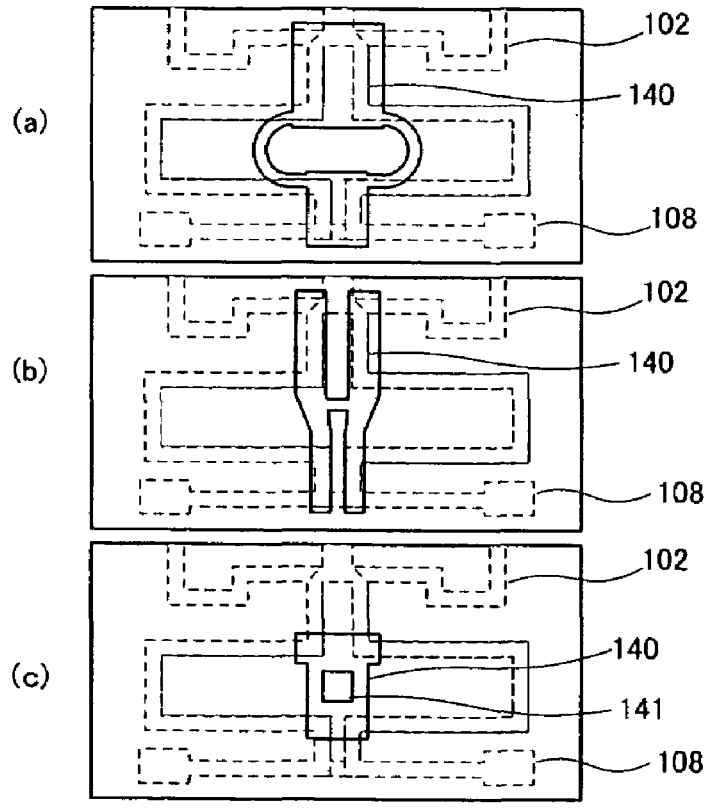
FIG. 62 is a seeing-through plan view showing still another example of the trap control coupling electrode shown in FIG. 60.

FIG. 62 is a seeing-through plan view showing still other examples of the trap control coupling electrode shown in FIG. 60. As shown at (a) in FIG. 62, the trap control coupling electrode may be formed to couple the dotted-line portions A and B shown in FIG. 59 through two curved narrow patterns separately bridging the left and right strip-lines in each side. Alternatively, as shown at (b) in FIG. 62, the trap control coupling electrode may be formed such that the dotted-line portions A and B shown in FIG. 59 are coupled by two independent lines extending in left and right sides, respectively, and those coupling lines are connected to each other at their midpoints. Furthermore, as shown at (c) in FIG. 62, the trap control coupling electrode may be formed in partly overlapped relation to the dotted-line portions A and B shown in FIG. 59 with an opening formed in a central portion of the coupling electrode.

Figure 63:
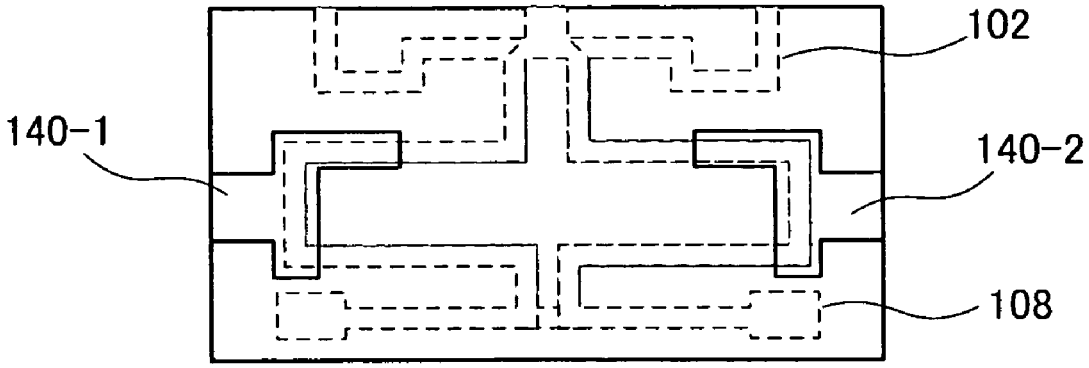
FIG. 63 is a seeing-through plan view showing still another example of the trap control coupling electrode shown in FIG. 60.

FIG. 63 is a seeing-through plan view showing still another example of the trap control coupling electrode shown in FIG. 60. As shown in FIG. 63, the trap control coupling electrode may be constituted as left and right coupling electrodes 140-1 and 140-2 such that the coupling is established between the unbalanced-side resonance electrode 102 and the stage constituting resonance electrode 108 in positions where the spacing between the left and right strip-lines constituting the unbalanced-side resonance electrode 102 and the stage constituting resonance electrode 108 are farthest away from each other, and the coupling electrodes 140-1 and 140-2 are connected to the GND terminals formed at respective sides.

According to the present invention, a balanced filter having a high attenuation can be realized with a simple structure, and therefore applications to radio communication equipment under demands for a further size reduction are expected.

What is claimed is:

1. A balanced filter device comprising:

an unbalanced-side resonance electrode coupled to an unbalanced terminal;

a balanced-side resonance electrode coupled to a balanced terminal; and a stage constituting resonance electrode coupled to the balanced terminal, wherein the unbalanced-side resonance electrode, the balanced-side resonance electrode, and the stage constituting resonance electrode are formed on respective dielectric layers in laminated arrangement, wherein the balanced-side resonance electrode is located between the unbalanced-side resonance electrode and the stage constituting resonance electrode.

2. The balanced filter device according to claim 1, wherein the stage constituting resonance electrode is formed in a comb-line arrangement opposing and facing said unbalanced-side resonance electrode and/or said balanced-side resonance electrode.

3. The balanced filter device according to claim 1, wherein the stage constituting resonance electrode is coupled to said balanced-side resonance electrode through an impedance element.

4. The balanced filter device according to claim 2, wherein coupling portions of said unbalanced-side resonance electrode and said balanced-side resonance electrode comprise $\lambda/4$ strip-lines, and wherein said stage constituting resonance electrode comprises a strip-line having a length different from $\lambda/4$.

5. The balanced filter device according to claim 1, wherein:

the stage constituting resonance electrode is arranged adjacent to said unbalanced-side resonance electrode and/or said balanced-side resonance electrode, and said unbalanced-side resonance electrode is arranged adjacent to said balanced-side resonance electrode.

6. The balanced filter device according to claim 1, wherein: said stage constituting resonance electrode is arranged opposite to said unbalanced-side resonance electrode or said balanced-side resonance electrode; and said unbalanced-side resonance electrode is arranged opposite to said balanced-side resonance electrode.

7. The balanced filter device according to claim 1, wherein:

the stage constituting resonance electrode is arranged adjacent to said unbalanced-side resonance electrode and/or said balanced-side resonance electrode; and said unbalanced-side resonance electrode, said balanced-side resonance electrode, and said stage constituting resonance electrode arc each comprise a strip-line.

8. The balanced filter device according to claim 1, having a strip-line structure, wherein:

the unbalanced-side resonance electrode is formed on a first dielectric layer;

the balanced-side resonance electrode is formed on a second dielectric layer; and the device further comprises:

a first ground electrode formed on a third dielectric layer; and a second ground electrodes formed on a fourth dielectric layer, wherein the first and second dielectric layers are between the third and fourth dielectric layers; and wherein:

the stage constituting resonance electrode is formed on a fifth dielectric layer;

said unbalanced-side resonance electrode is arranged opposite said balanced-side resonance electrode; and said balanced-side resonance electrode is arranged opposite said stage constituting resonance electrode.

9. The balanced filter device according to claim 8, further comprising a coupling electrode formed on a sixth dielectric layer, said coupling electrode being arranged between said balanced-side resonance electrode and said stage constituting resonance electrode.

10. The balanced filter device according to claim 8, further comprising a DC electrode formed on a sixth dielectric layer, said DC electrode being arranged between said stage constituting resonance electrode and said ground electrodes.

11. The balanced filter device according to claim 1 having a strip-line structure, wherein:

the unbalanced-side resonance electrode is formed on a first dielectric layer;

the balanced-side resonance electrode is formed on a second dielectric layer; and the device further comprises:

a first ground electrode formed on a third dielectric layer; and a second ground electrode formed on a fourth dielectric layer, wherein the first and second dielectric layers are positioned between the third and fourth dielectric layers; and wherein said stage constituting resonance electrode is formed on a fifth dielectric layer, and comprises a shorted end and an open end;

said unbalanced-side resonance electrode is arranged opposite to said balanced-side resonance electrode; and said balanced-side resonance electrode is arranged opposite to said stage constituting resonance electrode.

* * * * *